US012528569B2

(12) United States Patent
Murayama

(10) Patent No.: US 12,528,569 B2
(45) Date of Patent: Jan. 20, 2026

(54) MARINE VESSEL MANEUVERING SYSTEM, AND MARINE VESSEL

(71) Applicant: YAMAHA HATSUDOKI KABUSHIKI KAISHA, Iwata (JP)

(72) Inventor: Takuya Murayama, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 450 days.

(21) Appl. No.: 18/107,078

(22) Filed: Feb. 8, 2023

(65) Prior Publication Data

US 2023/0257090 A1 Aug. 17, 2023

(30) Foreign Application Priority Data

Feb. 17, 2022 (JP) ..... 2022-023011

(51) Int. Cl.
*B63H 11/11* (2006.01)
*B63H 11/113* (2006.01)
*B63H 21/21* (2006.01)

(52) U.S. Cl.
CPC ..... *B63H 11/11* (2013.01); *B63H 11/113* (2013.01); *B63H 21/21* (2013.01); *B63H 2021/216* (2013.01)

(58) Field of Classification Search
CPC ..... B63H 11/11
See application file for complete search history.

(56) References Cited

U.S. PATENT DOCUMENTS 6,386,930 B2 * 5/2002 Moffet ..... B63H 11/11 440/41
6,663,447 B1 * 12/2003 Bernier ..... F02D 41/021 114/151
6,865,996 B2 * 3/2005 Borrett ..... B63H 25/02 440/41
7,708,609 B2 * 5/2010 Plante ..... B63H 25/48 440/38
8,998,661 B2 * 4/2015 Kinoshita ..... F02D 41/021 440/1
9,403,586 B2 * 8/2016 Okamoto ..... B63H 11/107
9,527,564 B2 * 12/2016 Kinoshita ..... B63H 11/04
9,545,984 B2 * 1/2017 Okamoto ..... B63H 11/11
9,725,148 B2 * 8/2017 Kinoshita ..... B63H 11/11
10,040,518 B1 * 8/2018 Matsuda ..... B63H 11/04
(Continued)

FOREIGN PATENT DOCUMENTS

JP 6667935 B2 3/2020
JP 2021-011178 A 2/2021

*Primary Examiner* — Joseph W Sanderson
(74) *Attorney, Agent, or Firm* — Keating & Bennett, LLP

(57) ABSTRACT

A marine vessel maneuvering system includes a jet propulsion device to jet a water current out from a jetting port and obtain a propulsive force from a recoil of the jetted water current, a handle to change a direction of the jetting port, a reverse bucket to open and close the jetting port, and a controller configured or programmed to change the direction of the jetting port in accordance with a rotation angle of the handle. In a state in which the reverse bucket covers at least a portion of the jetting port and when the rotation angle of the handle exceeds a first threshold, the controller is configured or programmed to execute a turning assist control to reduce an amount by which the reverse bucket covers the jetting port.

20 Claims, 15 Drawing Sheets

(56) References Cited

U.S. PATENT DOCUMENTS

| | | | | |
|---|---|---|---|---|
| 10,191,490 | B2 * | 1/2019 | Akuzawa | B63H 25/04 |
| 10,227,123 | B1 * | 3/2019 | Araki | B63B 34/10 |
| 10,647,401 | B2 | 5/2020 | Tamura et al. | |
| 11,254,407 | B2 * | 2/2022 | Koyano | B63H 25/02 |
| 2001/0029134 | A1 * | 10/2001 | Moffet | B63H 11/113 440/41 |
| 2003/0019414 | A1 * | 1/2003 | Borrett | B63H 25/02 114/144 B |
| 2009/0275248 | A1 * | 11/2009 | Plante | B63H 25/48 440/41 |
| 2013/0344754 | A1 * | 12/2013 | Kinoshita, I | F02D 41/021 440/1 |
| 2015/0118069 | A1 * | 4/2015 | Kinoshita | B63H 11/11 417/76 |
| 2016/0039503 | A1 * | 2/2016 | Kinoshita | B63H 11/113 415/35 |
| 2016/0039505 | A1 * | 2/2016 | Okamoto | B63H 11/11 440/40 |
| 2016/0039506 | A1 * | 2/2016 | Okamoto | B63H 11/11 415/35 |
| 2017/0274973 | A1 * | 9/2017 | Tamura | B63H 21/21 |
| 2018/0004209 | A1 * | 1/2018 | Akuzawa | G05D 1/0206 |
| 2019/0061894 | A1 * | 2/2019 | Araki | F02D 11/02 |
| 2020/0047859 | A1 * | 2/2020 | Kinomoto | B63B 34/10 |
| 2021/0001971 | A1 | 1/2021 | Koyano | |
| 2024/0132196 | A1 * | 4/2024 | Shirao | B63B 79/40 |
| 2024/0228007 | A9 * | 7/2024 | Shirao | B63H 25/46 |

* cited by examiner

MARINE VESSEL MANEUVERING SYSTEM, AND MARINE VESSEL

CROSS REFERENCE TO RELATED APPLICATIONS

This application claims the benefit of priority to Japanese Patent Application No. 2022-023011, filed on Feb. 17, 2022. The entire contents of this application are hereby incorporated herein by reference.

BACKGROUND OF THE INVENTION

1. Field of the Invention

The present invention relates to a marine vessel maneuvering system and a marine vessel that include jet propulsion devices.

2. Description of the Related Art

Relatively small marine vessels, which include jet propulsion devices that each jets water from a nozzle toward the rear of a hull and obtains a propulsive force in a forward moving direction from the recoil of the jetted water, are known. Some of such relatively small marine vessels include the jet propulsion devices located on the port side and the starboard side, a yaw moment is generated by changing a direction of the water (a jet flow) jetted by each jet propulsion device to the left or the right by a deflector attached to the nozzle, and the yaw moment causes the marine vessel to change its traveling direction (its moving direction) to the left or the right. In addition, the jet propulsion device is provided with a reverse bucket, the direction of the jet flow from the nozzle is changed to the front of the hull by the reverse bucket covering the deflector, and as a result, the jet propulsion device obtains a propulsive force in a backward moving direction.

However, since the yaw moment depends on the propulsive force generated by the recoil of the jet flow, in the case in which the propulsive force is small, that is, in the case in which a vessel speed of the marine vessel is low, the yaw moment becomes small, and turning performance of the marine vessel is degraded. Therefore, such a technique, in which when the vessel speed of the marine vessel is low, the yaw moment acting on the hull is increased by changing the direction of the jet flow of one of the two jet propulsion devices to the left or the right by the deflector and by changing the direction of the jet flow of the other of the two jet propulsion devices to the front of the hull by the reverse bucket to improve the turning performance of the marine vessel, has been proposed (for example, see Japanese Laid-Open Patent Publication (kokai) No. 2021-11178).

However, in the technique disclosed in Japanese Laid-Open Patent Publication (kokai) No. 2021-11178, an acting direction of the propulsive force of one of the two jet propulsion devices is changed to the backward moving direction. In addition, in order to change the direction of the jet flow to the front of the hull, when the reverse bucket moves so as to cover the deflector, it is necessary to stop the jet flow momentarily, and the generation of the propulsive force will be interrupted. That is, in the technique disclosed in Japanese Laid-Open Patent Publication (kokai) No. 2021-11178, when the marine vessel turns, a feeling of deceleration felt by passengers increases. Therefore, there is room for improvement in the riding comfort when the marine vessel turns.

SUMMARY OF THE INVENTION

Preferred embodiments of the present invention provide marine vessel maneuvering systems and marine vessels that are each able to improve riding comfort when a marine vessel turns.

According to a preferred embodiment of the present invention, a marine vessel maneuvering system includes a jet propulsion device to jet a water current out from a jetting port and obtain a propulsive force from a recoil of the jetted water current, a handle to change a direction of the jetting port, a reverse bucket to open and close the jetting port, and a controller configured or programmed to change the direction of the jetting port in accordance with a rotation angle of the handle. In a state in which the reverse bucket covers at least a portion of the jetting port and the rotation angle of the handle exceeds a first threshold, the controller is configured or programmed to execute a turning assist control to reduce an amount by which the reverse bucket covers the jetting port.

According to another preferred embodiment of the present invention, a marine vessel maneuvering system includes a jet propulsion device to jet a water current out from a jetting port and obtain a propulsive force from a recoil of the jetted water current, a handle to change a direction of the jetting port, a reverse bucket to open and close the jetting port, and a controller configured or programmed to change the direction of the jetting port in accordance with a rotation angle of the handle. In a state in which a marine vessel has shifted to a low-speed navigating mode and the rotation angle of the handle exceeds a first threshold, the controller is configured or programmed to reduce an amount by which the reverse bucket covers the jetting port.

According to another preferred embodiment of the present invention, a marine vessel maneuvering system includes a jet propulsion device to jet a water current out from a jetting port and obtain a propulsive force from a recoil of the jetted water current, a handle to change a direction of the jetting port, a controller configured or programmed to change the direction of the jetting port in accordance with a rotation angle of the handle, and a power source corresponding to the jet propulsion device to generate the water current. The propulsive force increases when a rotation number of a rotating body of the power source increases. When the rotation angle of the handle exceeds a predetermined threshold, the controller is configured or programmed to increase the rotation number of the rotating body of the power source.

According to another preferred embodiment of the present invention, a marine vessel includes a jet propulsion device to jet a water current out from a jetting port and obtain a propulsive force from a recoil of the jetted water current, a handle to change a direction of the jetting port, a reverse bucket to open and close the jetting port, and a controller configured or programmed to change the direction of the jetting port in accordance with a rotation angle of the handle. In a state in which the reverse bucket covers at least a portion of the jetting port and the rotation angle of the handle exceeds a first threshold, the controller is configured or programmed to execute a turning assist control that reduces an amount by which the reverse bucket covers the jetting port.

According to another preferred embodiment of the present invention, a marine vessel includes a jet propulsion device to jet a water current out from a jetting port and obtain a propulsive force from a recoil of the jetted water current, a handle to change a direction of the jetting port, a reverse bucket to open and close the jetting port, and a controller configured or programmed to change the direction of the jetting port in accordance with a rotation angle of the handle. In a state in which the marine vessel has shifted to a low-speed navigating mode and the rotation angle of the handle exceeds a first threshold, the controller is configured or programmed to reduce an amount by which the reverse bucket covers the jetting port.

According to another preferred embodiment of the present invention, a marine vessel includes a jet propulsion device to jet a water current out from a jetting port and obtain a propulsive force from a recoil of the jetted water current, a handle to change a direction of the jetting port, a controller configured or programmed to change the direction of the jetting port in accordance with a rotation angle of the handle, and a power source corresponding to the jet propulsion device to generate the water current. The propulsive force increases when a rotation number of a rotating body of the power source increases. When the rotation angle of the handle exceeds a predetermined threshold, the controller is configured or programmed to increase the rotation number of the rotating body of the power source.

According to a preferred embodiment of the present invention, since in the state in which the reverse bucket covers at least a portion of the jetting port that jets the water current out, or in the state in which the marine vessel has shifted to the low-speed navigating mode, when the rotation angle of the handle exceeds the first threshold, the amount by which the reverse bucket covers the jetting port is reduced, or when the rotation angle of the handle exceeds the predetermined threshold, the rotation number of the rotating body of the power source is increased, the water current jetted from the jetting port whose direction is changed increases in accordance with the rotation angle of the handle, and the propulsive force increases. As a result, a component force of the propulsive force in the left direction or the right direction of the hull also increases, thus the yaw moment is increased. That is, in order to increase the yaw moment to turn the hull, since it is not necessary to change the acting direction of the propulsive force of one of the two jet propulsion devices to the backward moving direction, it is possible to reduce the feeling of deceleration felt by the passengers, and as a result, it is possible to improve the riding comfort when the marine vessel turns.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

First, a first preferred embodiment of the present invention will be described.

Figure 1:
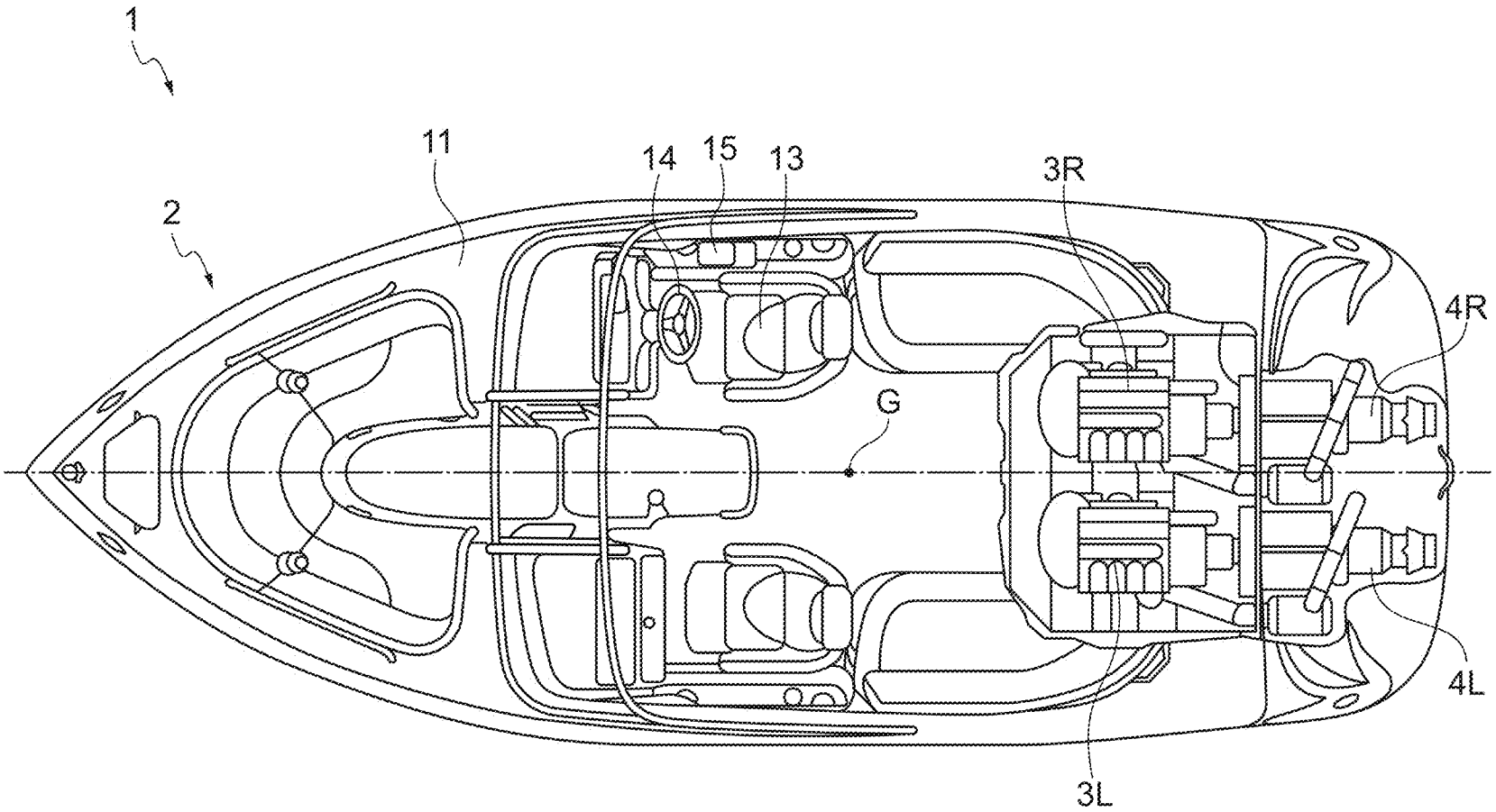
FIG. 1 is a plan view of a marine vessel according to a first preferred embodiment of the present invention.
Figure 2:
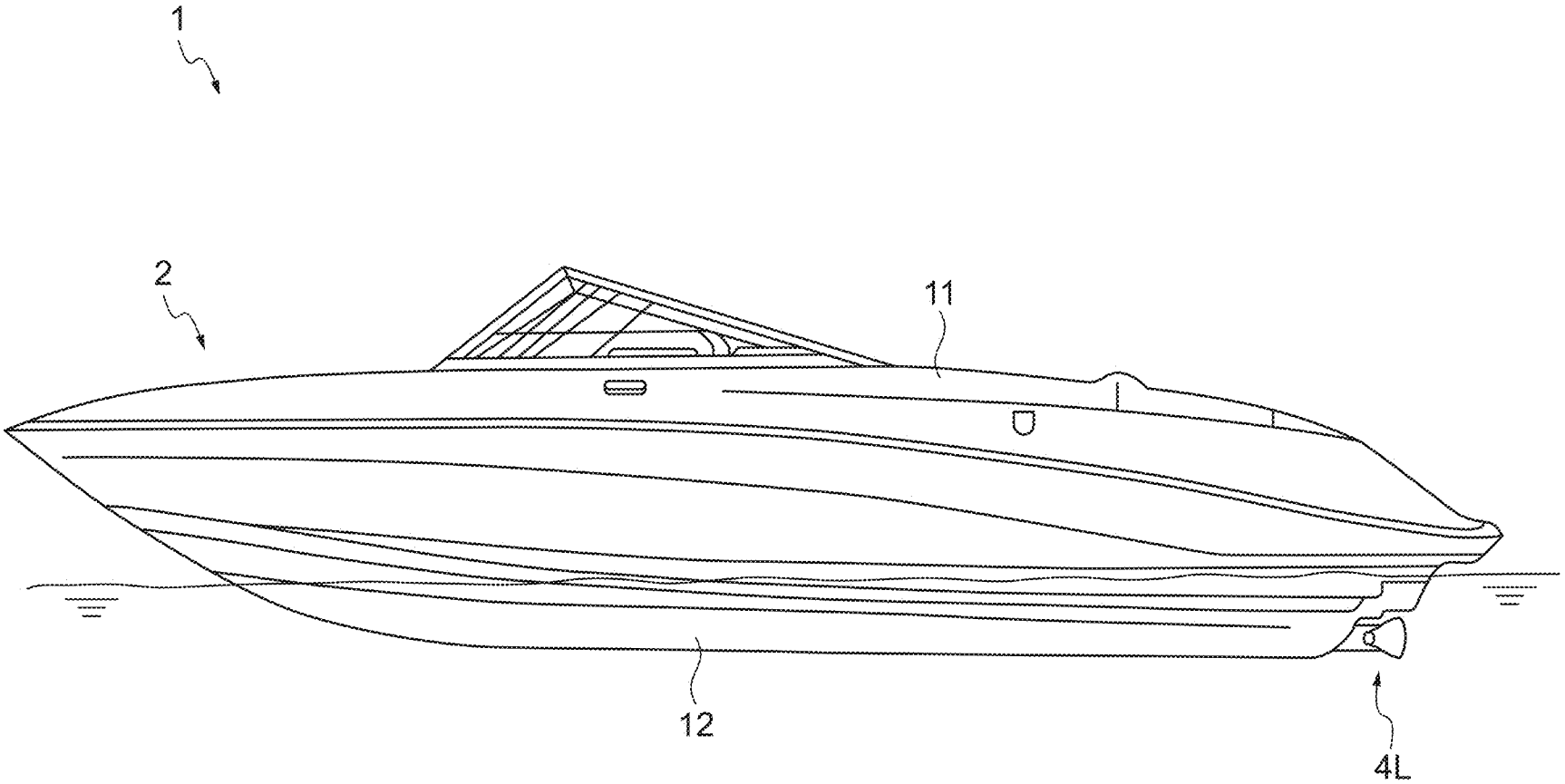
FIG. 2 is a side view of the marine vessel according to the first preferred embodiment of the present invention.

FIG. 1 is a plan view of a marine vessel according to the first preferred embodiment of the present invention. A marine vessel maneuvering system according to the first preferred embodiment of the present invention is applied to a marine vessel 1. FIG. 1 shows a portion of an internal configuration of the marine vessel 1. FIG. 2 is a side view of the marine vessel 1. The marine vessel 1 is, for example, a jet propulsion boat, and is such a marine vessel called a jet boat or a sports boat.

The marine vessel 1 includes a hull 2, engines 3L and 3R (power sources), and marine vessel propulsion devices 4L and 4R. The hull 2 includes a deck 11 and a hull 12. The hull 12 is located below the deck 11. A maneuvering seat 13 is located on the deck 11. A steering apparatus 14 to change a traveling direction (a moving direction) of the marine vessel 1 to the left or the right, and a remote control unit 15 to control the traveling direction of the marine vessel 1 and a speed of the marine vessel 1 are located near the maneuvering seat 13.

The engine 3L is located on the port side of the hull 2, and the engine 3R is located on the starboard side of the hull 2. The marine vessel propulsion device 4L is located on the port side of the hull 2 and corresponds to the engine 3L, and the marine vessel propulsion device 4R is located on the starboard side of the hull 2 and corresponds to the engine 3R. An output shaft of the engine 3L is connected to the marine vessel propulsion device 4L, and an output shaft of the engine 3R is connected to the marine vessel propulsion device 4R. The marine vessel propulsion device 4L and the marine vessel propulsion device 4R are driven by the engine 3L and the engine 3R, respectively, and generate a propulsive force that moves the hull 2. In the marine vessel 1, the number of the engines is not limited to two, and may be one or may be three or more, and, the number of the marine vessel propulsion devices is not limited to two, and may be one or may be three or more. It should be noted that in the following description, a reference numeral "L" indicates that it is located on the port side of the hull 2, and a reference numeral "R" indicates that it is located on the starboard side of the hull 2.

Figure 3A:
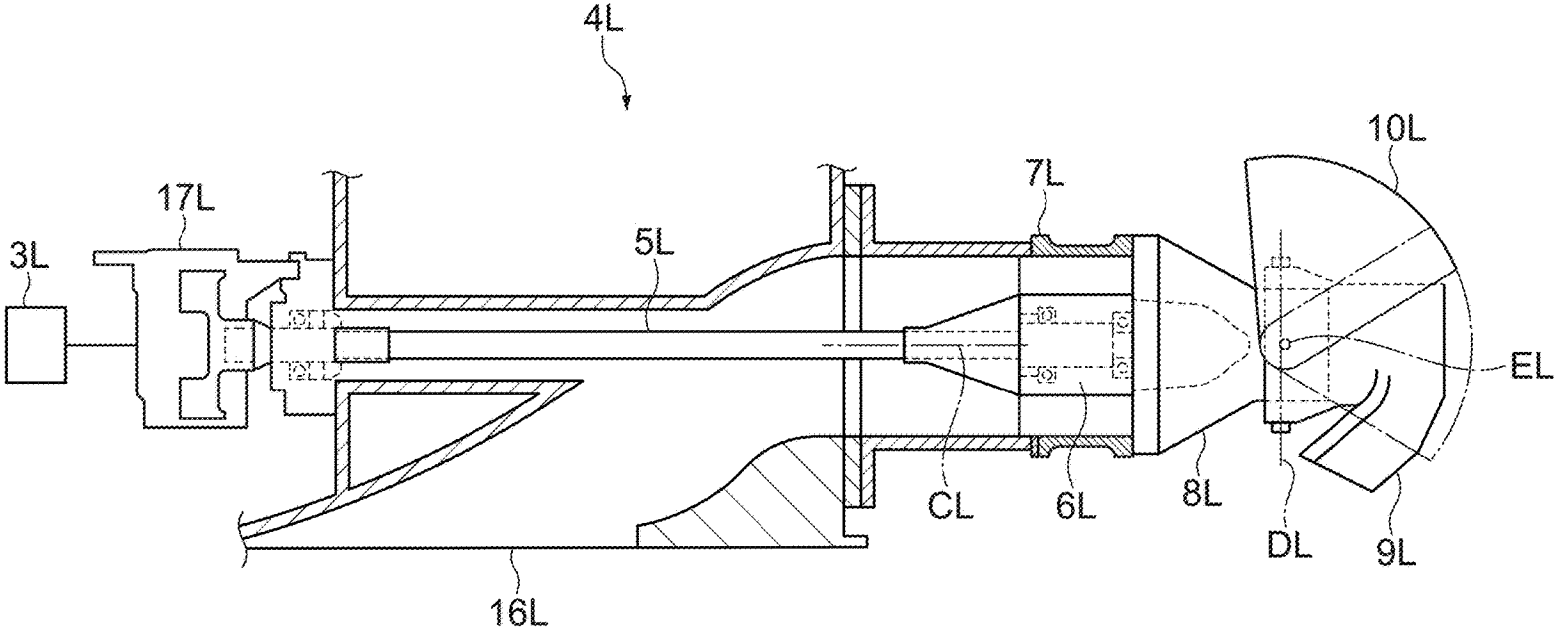
FIGS. 3A and 3B are views for explaining a configuration of a marine vessel propulsion device in the first preferred embodiment of the present invention.
Figure 3B:
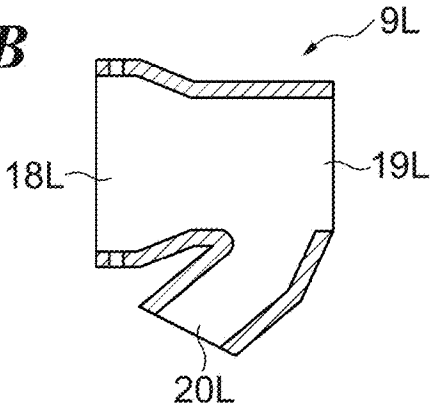

FIGS. 3A and 3B are views for explaining a configuration of the marine vessel propulsion device 4L, FIG. 3A is a schematic side view, and FIG. 3B is a cross sectional view of a deflector 9L included in the marine vessel propulsion device 4L. In FIG. 3A, a portion of the marine vessel propulsion device 4L is shown in a cross section. The marine vessel propulsion device 4L is a jet propulsion device that sucks in water around the hull 2 and jets the sucked in water toward the rear of the hull 2. The left direction in FIG. 3A corresponds to the forward direction of the hull 2, and the right direction in FIG. 3A corresponds to the backward direction of the hull 2. The depth direction in FIG. 3A corresponds to the right direction of the hull 2, and the front direction in FIG. 3A corresponds to the left direction of the hull 2. Since the marine vessel propulsion device 4R has the same configuration as the marine vessel propulsion device 4L, the description of the configuration of the marine vessel propulsion device 4R is omitted.

As shown in FIG. 3A, the marine vessel propulsion device 4L includes an impeller shaft 5L, an impeller 6L, an impeller housing 7L, a nozzle 8L, the deflector 9L, a reverse bucket 10L, and a water suction portion 16L. The impeller shaft 5L extends in a front-rear direction of the hull 2. A front portion of the impeller shaft 5L is connected to the output shaft of the engine 3L via a coupling 17L. A rear portion of the impeller shaft 5L is located inside the impeller housing 7L, and the impeller housing 7L is located behind the water suction portion 16L, which is an opening. The nozzle 8L is located behind the impeller housing 7L.

The impeller 6L is attached to the rear portion of the impeller shaft 5L and is located inside the impeller housing 7L. The impeller 6L includes a plurality of blades (not shown) radially located around a rotation axis line CL, rotates together with the impeller shaft 5L, and sucks the water from the water suction portion 16L. The impeller 6L jets the sucked in water backward from a jetting port of the nozzle 8L.

The deflector 9L is located behind the nozzle 8L and changes a jetting direction of the water jetted from the jetting port of the nozzle 8L to the left direction or the right direction with respect to the hull 2. The deflector 9L is a hollow case-shaped body, and includes a water current inlet port 18L that opens toward the front of the hull 2 and houses the jetting port of the nozzle 8L, a forward moving jetting port 19L that opens toward the rear of the hull 2, and a backward moving jetting port 20L that opens toward the front of the hull 2.

The forward moving jetting port 19L preferably has, for example, a cylindrical shape, and the backward moving jetting port 20L preferably has, for example, a tubular shape with a rectangular cross section. As shown in FIG. 3B, the water current inlet port 18L, the forward moving jetting port 19L, and the backward moving jetting port 20L communicate with each other. In the deflector 9L, the water jetted from the jetting port of the nozzle 8L is introduced into the water current inlet port 18L, and depending on a position of the reverse bucket 10L which will be described below, the introduced water is jetted toward the rear of the hull 2 from the forward moving jetting port 19L, or is jetted toward the front of the hull 2 from the backward moving jetting port 20L.

The deflector 9L is attached to the nozzle 8L so as to be rotationally movable to the left or the right with respect to the hull 2 around a rotational axis line DL extending in the vertical direction of the hull 2. A steering actuator 22L (described below) is connected to the deflector 9L, and the steering actuator 22L changes the direction of the deflector 9L to the left or the right in accordance with a rotation operation of a wheel portion 37 (described below) of the steering apparatus 14. Thus, the deflector 9L is able to change the direction of the water jetted from the forward moving jetting port 19L or the backward moving jetting port 20L to the left or the right, and as a result, the deflector 9L is able to change the traveling direction of the marine vessel 1.

The reverse bucket 10L is located behind the deflector 9L. The reverse bucket 10L is attached to the deflector 9L so as to be rotationally movable upward or downward with respect to the hull 2 around a rotational axis line EL extending in the left/right direction of the hull 2. It should be noted that since the reverse bucket 10L is attached to the deflector 9L, the reverse bucket 10L is able to rotationally move to the left or the right together with the deflector 9L.

The reverse bucket 10L is able to rotationally move upward or downward between a fully open position and a fully closed position. The fully open position is a position when the reverse bucket 10L is retreated above the forward moving jetting port 19L of the deflector 9L. The fully open position is indicated by a solid line in FIG. 3A. In the case in which the reverse bucket 10L is positioned at the fully open position, when the forward moving jetting port 19L is viewed from the rear of the hull 2, the reverse bucket 10L does not cover the forward moving jetting port 19L at all. On the other hand, the fully closed position is a position when the reverse bucket 10L faces the forward moving jetting port 19L of the deflector 9L. The fully closed position is indicated by a two-dot chain line in FIG. 3A. In the case in which the reverse bucket 10L is positioned at the fully closed position, when the forward moving jetting port 19L is viewed from the rear of the hull 2, the reverse bucket 10L covers the entire forward moving jetting port 19L. At this time, since the water is no longer jetted from the forward moving jetting port 19L, the water is jetted toward the front of the hull 2 from the backward moving jetting port 20L. That is, the reverse bucket 10L changes the direction of the current of the water jetted toward the rear of the hull 2 from the nozzle 8L via the deflector 9L to the front of the hull 2. In addition, since the backward moving jetting port 20L opens forward and downward, although the water is actually jetted forward and downward from the backward moving jetting port 20L, the component of the backward direction of the propulsive force generated by the recoil of the jetted water moves the marine vessel 1 backward.

Although the forward moving jetting port 19L does not point downward or upward, but opens backward so that the direction of the jetted water becomes parallel to the front-rear direction of the hull 2, the forward moving jetting port 19L may open backward and downward. In addition, although the backward moving jetting port 20L opens forward and downward, the backward moving jetting port 20L may open forward so that the direction of the jetted water becomes parallel to the front-rear direction of the hull 2 without the backward moving jetting port 20L pointing downward or upward.

Figure 4:
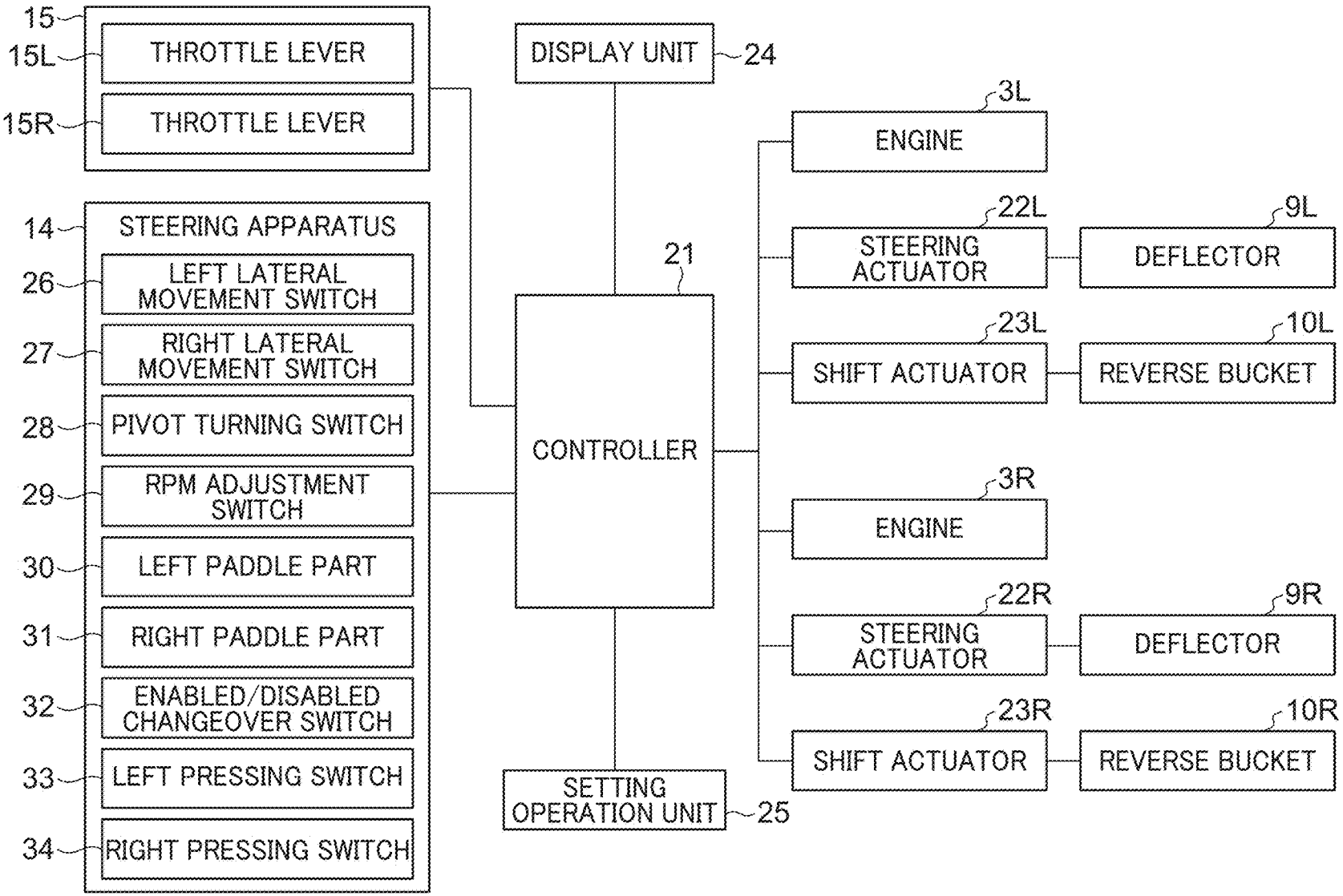
FIG. 4 is a block diagram of a control system of a marine vessel including a marine vessel maneuvering system according to the first preferred embodiment of the present invention.

Next, a control system of the marine vessel 1 will be described. FIG. 4 is a block diagram of the control system of the marine vessel 1 including the marine vessel maneuvering system according to the first preferred embodiment of the present invention.

As shown in FIG. 4, the marine vessel maneuvering system according to the first preferred embodiment of the present invention includes the steering apparatus 14, the remote control unit 15, and a controller 21 (a controller). The controller 21 includes a processor (not shown) such as a CPU (Central Processing Unit) and storage devices (not shown) such as a RAM (Random Access Memory) and a ROM (Read Only Memory), and controls the marine vessel 1 by executing stored programs. The controller 21 may include a single control unit, or may include a plurality of control units. The controller 21 is communicably connected to the steering apparatus 14.

The marine vessel maneuvering system of the marine vessel 1 (the marine vessel maneuvering system according to the first preferred embodiment of the present invention) includes the steering actuator 22L and a shift actuator 23L. The controller 21 is communicably connected to the engine 3L, the steering actuator 22L, and the shift actuator 23L. The steering actuator 22L is connected to the deflector 9L of the marine vessel propulsion device 4L, and rotationally moves the deflector 9L around the rotational axis line DL. The steering actuator 22L includes, for example, an electric motor. Alternatively, the steering actuator 22L may be another actuator such as a hydraulic cylinder. The shift actuator 23L is connected to the reverse bucket 10L of the marine vessel propulsion device 4L. By moving forward or backward, the shift actuator 23L rotationally moves the reverse bucket 10L upward or downward between the fully open position and the fully closed position. The shift actuator 23L includes, for example, an electric motor. Alternatively, the shift actuator 23L may be another actuator such as a hydraulic cylinder.

The marine vessel maneuvering system of the marine vessel 1 includes a steering actuator 22R and a shift actuator 23R. The controller 21 is communicably connected to the engine 3R, the steering actuator 22R, and the shift actuator 23R. The steering actuator 22R and the shift actuator 23R have the same configurations and functions as the steering actuator 22L and the shift actuator 23L, respectively.

The remote control unit 15 includes a throttle lever 15L and a throttle lever 15R. The throttle lever 15L and the throttle lever 15R are operable to move toward a forward moving direction and move toward a backward moving direction from a zero operation position (a neutral position), respectively.

The controller 21 detects an operation amount of the throttle lever 15L and an operation amount of the throttle lever 15R by using a sensor (not shown) of the remote control unit 15, controls a rotation number of a crankshaft (a rotating body) of the engine 3L in accordance with the operation amount of the throttle lever 15L, and controls a rotation number of a crankshaft (a rotating body) of the engine 3R in accordance with the operation amount of the throttle lever 15R. When the rotation number of the crankshaft of the engine 3L (hereinafter, referred to as "a rotation number of the engine 3L") and the rotation number of the crankshaft of the engine 3R (hereinafter, referred to as "a rotation number of the engine 3R") increase, a rotation number of the impeller 6L and a rotation number of the impeller 6R also increase, and the amount of the water jetted from the jetting port of the nozzle 8L and the amount of the water jetted from a jetting port of a nozzle 8R increase, and as a result, the propulsive force generated by the recoil of the water jetted from the forward moving jetting port 19L of the deflector 9L and the recoil of the water jetted from a forward moving jetting port 19R of a deflector 9R increases. Thus, the speed of the marine vessel 1 is adjusted.

The controller 21 controls the shift actuator 23L in accordance with the operation amount and an operation direction of the throttle lever 15L to rotationally move the reverse bucket 10L upward or downward between the fully open position and the fully closed position, and controls the shift actuator 23R in accordance with the operation amount and an operation direction of the throttle lever 15R to rotationally move a reverse bucket 10R upward or downward between the fully open position and the fully closed position. As a result, switching between forward moving and backward moving of the marine vessel 1 is performed. Rotationally moving the reverse bucket 10L corresponding to an operation of the throttle lever 15L and rotationally moving the reverse bucket 10R corresponding to an operation of the throttle lever 15R will be described below in detail.

The marine vessel maneuvering system of the marine vessel 1 includes a display unit 24 and a setting operation unit 25. The display unit 24 includes a display and displays various kinds of information based on instructions from the controller 21. The setting operation unit 25 includes an operation element (not shown) operated by a marine vessel operator, a setting operation element (not shown) to perform various kinds of settings, and an inputting operation element (not shown) to input various kinds of instructions. Signals inputted by the setting operation unit 25 are transmitted to the controller 21.

In the marine vessel maneuvering system, the steering apparatus 14 includes a left lateral movement switch 26, a right lateral movement switch 27, a pivot turning switch 28, an RPM (revolutions per minute) adjustment switch 29, a left paddle 30, a right paddle 31, an enabled/disabled changeover switch 32, a left pressing switch 33, and a right pressing switch 34. The switches 26, 27, 28, 29, 32, 33, and 34, and the paddles 30 and 31 are operated by the marine vessel operator, and operation signals of the switches 26, 27, 28, 29, 32, 33, and 34, and the paddles 30 and 31 are supplied to the controller 21. Functions and arrangements of the switches 26, 27, 28, 29, 32, 33, and 34, and the paddles 30 and 31 will be described below.

Here, various kinds of marine vessel maneuvering modes in the marine vessel 1 will be described. The marine vessel maneuvering modes are roughly divided into "high-speed navigating modes" and "low-speed navigating modes". The low-speed navigating modes include "lateral thrust generation modes" and "a pivot turning mode". The lateral thrust generation modes include "lateral movement modes" and "pressing modes". Specifically, the lateral movement modes include a left lateral movement mode and a right lateral movement mode, and the pressing modes include a left pressing mode and a right pressing mode.

The high-speed navigating mode is a mode used to make the marine vessel 1 navigate at a relatively high speed in the open sea. In the high-speed navigating mode, both the rotation number of the engine 3L and the rotation number of the engine 3R are allowed up to a maximum rotation number. In addition, in the high-speed navigating mode, the reverse bucket 10L is positioned at the fully open position and does not cover the forward moving jetting port 19L at all.

The low-speed navigating mode is a mode used to make the marine vessel 1 navigate at a relatively low speed when moving within a harbor or when fishing. In the low-speed navigating mode, both the upper limit of the rotation number of the engine 3L and the upper limit of the rotation number of the engine 3R are limited to a predetermined rotation number lower than the maximum rotation number. In addition, in the low-speed navigating mode, the reverse bucket 10L is positioned between the fully open position and the fully closed position, and covers at least a portion of the forward moving jetting port 19L.

Switching between the high-speed navigating mode and the low-speed navigating mode is performed in accordance with the operation of the enabled/disabled changeover switch 32. For example, when the marine vessel operator operates the enabled/disabled changeover switch 32, the enabled/disabled changeover switch 32 transmits an operation signal to the controller 21 to notify that the enabled/disabled changeover switch 32 has been operated, and the controller 21 that has received the operation signal performs the switching between the high-speed navigating mode and the low-speed navigating mode by controlling the engine 3L and the engine 3R. In the first preferred embodiment, the switching between the high-speed navigating mode and the low-speed navigating mode is performed each time the enabled/disabled changeover switch 32 is operated.

FIGS. 5A, 5B, 5C, and 5D are views for explaining rotationally moving the reverse bucket 10L in the marine vessel propulsion device 4L corresponding to the operation of the throttle lever 15L. It should be noted that in the following description, "a bucket opening" is used as an index of an amount by which the reverse bucket 10L covers the forward moving jetting port 19L when the forward moving jetting port 19L is viewed from the rear of the hull 2. Specifically, when the reverse bucket 10L covers the entire forward moving jetting port 19L at the fully closed position, the bucket opening becomes 0%, and on the other hand, when the reverse bucket 10L does not cover the forward moving jetting port 19L at all at the fully open position, the bucket opening becomes 100%. In addition, between the fully closed position and the fully open position, the bucket opening is expressed as an index of a rotational angle of the reverse bucket 10L when the entire rotational angle range of the reverse bucket 10L is equally divided into 100. For example, when the reverse bucket 10L is positioned midway between the fully closed position and the fully open position, the bucket opening becomes 50%. In each of FIGS. 5A, 5B, 5C, and 5D, a cross sectional view of the reverse bucket 10L is schematically shown on the left side, and a state when the reverse bucket 10L is viewed from the rear of the hull 2 is schematically shown on the right side.

Figure 5A:
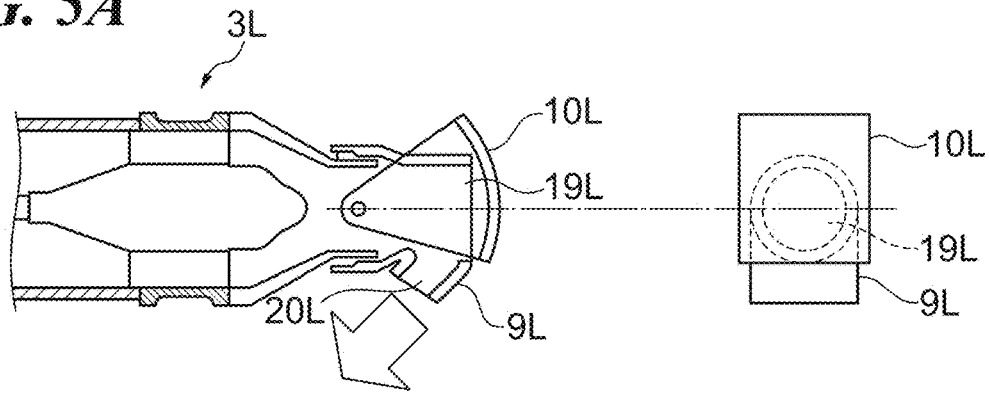
FIGS. 5A, 5B, 5C, and 5D are views for explaining rotationally moving a reverse bucket in the marine vessel propulsion device corresponding to an operation of a throttle lever.

FIG. 5A shows a case in which the marine vessel operator moves the throttle lever 15L in the backward moving direction. In this case, the reverse bucket 10L rotationally moves downward and to the fully closed position, and covers the entire forward moving jetting port 19L when the forward moving jetting port 19L is viewed from the rear of the hull 2. That is, the bucket opening is 0%. At this time, the deflector 9 jets the water forward and downward of the hull 2 from the backward moving jetting port 20L, but does not jet the water backward of the hull 2 at all. Therefore, the marine vessel 1 moves backward.

Figure 5B:
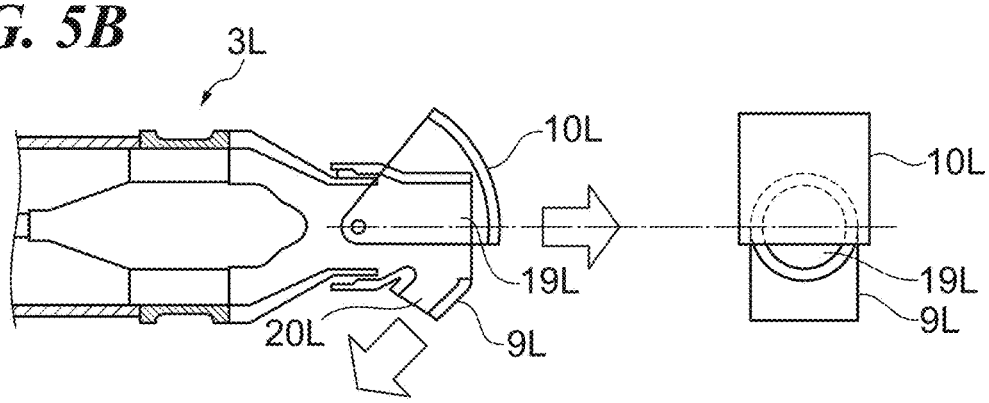

FIG. 5B shows a case in which the marine vessel operator moves the throttle lever 15L to the neutral position. In this case, the reverse bucket 10L rotationally moves slightly upward from the fully closed position, and exposes a portion of the forward moving jetting port 19L when the forward moving jetting port 19L is viewed from the rear of the hull 2. The bucket opening at this time is 35%, and in this example, 65% of the opening area of the forward moving jetting port 19L is covered with the reverse bucket 10L. At this time, the water is jetted backward of the hull 2 from a region of the forward moving jetting port 19L that is not covered with the reverse bucket 10L. In addition, the water is also jetted forward and downward of the hull 2 from the backward moving jetting port 20L. The amount of the water jetted forward and downward of the hull 2 is smaller than when the bucket opening is 0%, and a propulsive force in the forward moving direction generated by the recoil of the water jetted backward of the hull 2 and a propulsive force in the backward moving direction generated by the recoil of the water jetted forward and downward of the hull 2 are substantially balanced. As a result, when the throttle lever 15L is positioned at the neutral position, the location of the hull 2 is held on the spot.

Figure 5C:
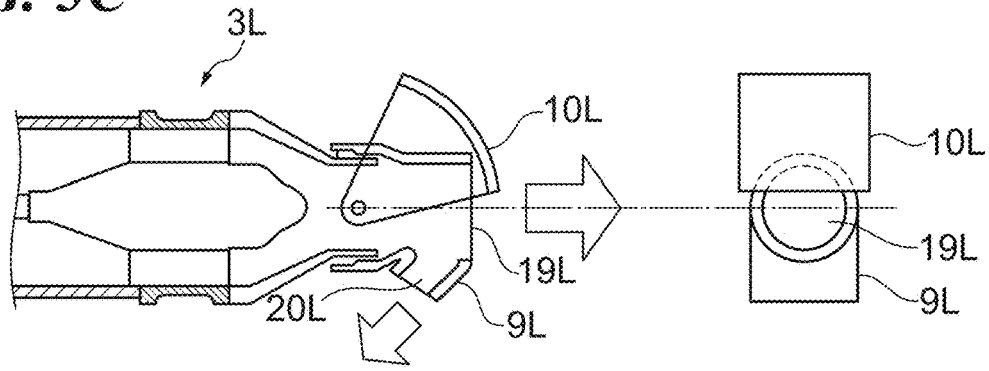

FIG. 5C shows a case in which the marine vessel operator moves the throttle lever 15L in the forward moving direction in the low-speed navigating mode. In this case, the reverse bucket 10L rotationally moves farther upward than when the bucket opening is 35% (that is, when the throttle lever 15L is moved to the neutral position), and covers a portion of the forward moving jetting port 19L when the forward moving jetting port 19L is viewed from the rear of the hull 2. The bucket opening at this time is, for example, 70%, and in this example, 30% of the opening area of the forward moving jetting port 19L is covered with the reverse bucket 10L. At this time, although the water is jetted backward of the hull 2 from a region of the forward moving jetting port 19L that is not covered with the reverse bucket 10L and the water is jetted forward and downward of the hull 2 from the backward moving jetting port 20L, the amount of the water jetted backward of the hull 2 increases more than when the bucket opening is 35%, and the amount of the water jetted forward and downward of the hull 2 is smaller than when the bucket opening is 35%. Therefore, the propulsive force in the forward moving direction generated by the recoil of the water jetted backward of the hull 2 exceeds the propulsive force in the backward moving direction generated by the recoil of the water jetted forward and downward of the hull 2. As a result, in the low-speed navigating mode, when the throttle lever 15L is moved in the forward moving direction, the marine vessel 1 moves forward at a relatively low speed.

It should be noted that in the low-speed navigating mode, since the bucket opening (a moving range of the reverse bucket 10L) is usually limited to a predetermined range, for example, a range up to 70%, it does not occur that the bucket opening becomes 100%, that is, it does not occur that the reverse bucket 10L does not cover the forward moving jetting port 19L at all.

Figure 5D:
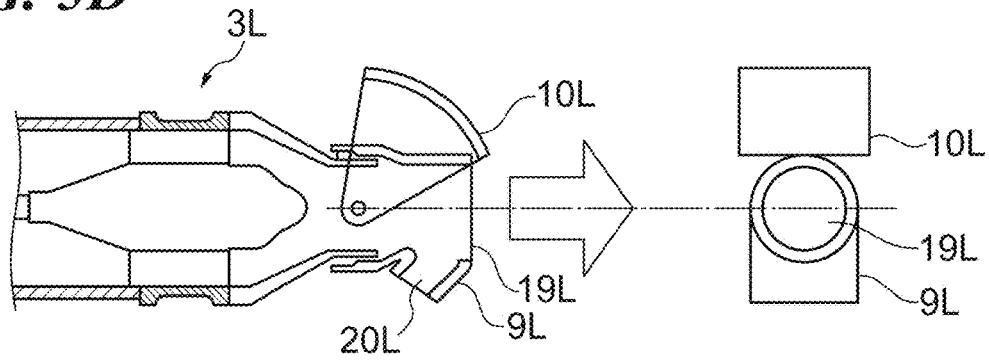

FIG. 5D shows a case in which the marine vessel operator moves the throttle lever 15L in the forward moving direction in the high-speed navigating mode. In this case, the reverse bucket 10L rotationally moves upward to the fully open position, and does not cover the forward moving jetting port 19L at all when the forward moving jetting port 19L is viewed from the rear of the hull 2. That is, the bucket opening becomes 100%. At this time, most of the water introduced into the water current inlet port 18L is jetted backward of the hull 2 from the forward moving jetting port 19L, and almost no water is jetted forward and downward of the hull 2 from the backward moving jetting port 20L. Therefore, only the propulsive force in the forward moving direction generated by the recoil of the water jetted backward of the hull 2 acts on the hull 2, and as a result, in the high-speed navigating mode, when the throttle lever 15L is moved in the forward moving direction, the marine vessel 1 moves forward at a relatively high speed.

In the marine vessel propulsion device 4R, since the reverse bucket 10R rotationally moves in the same manner as the reverse bucket 10L in accordance with the operation of the throttle lever 15R, the description of the operation of the reverse bucket 10R is omitted.

Figure 6:
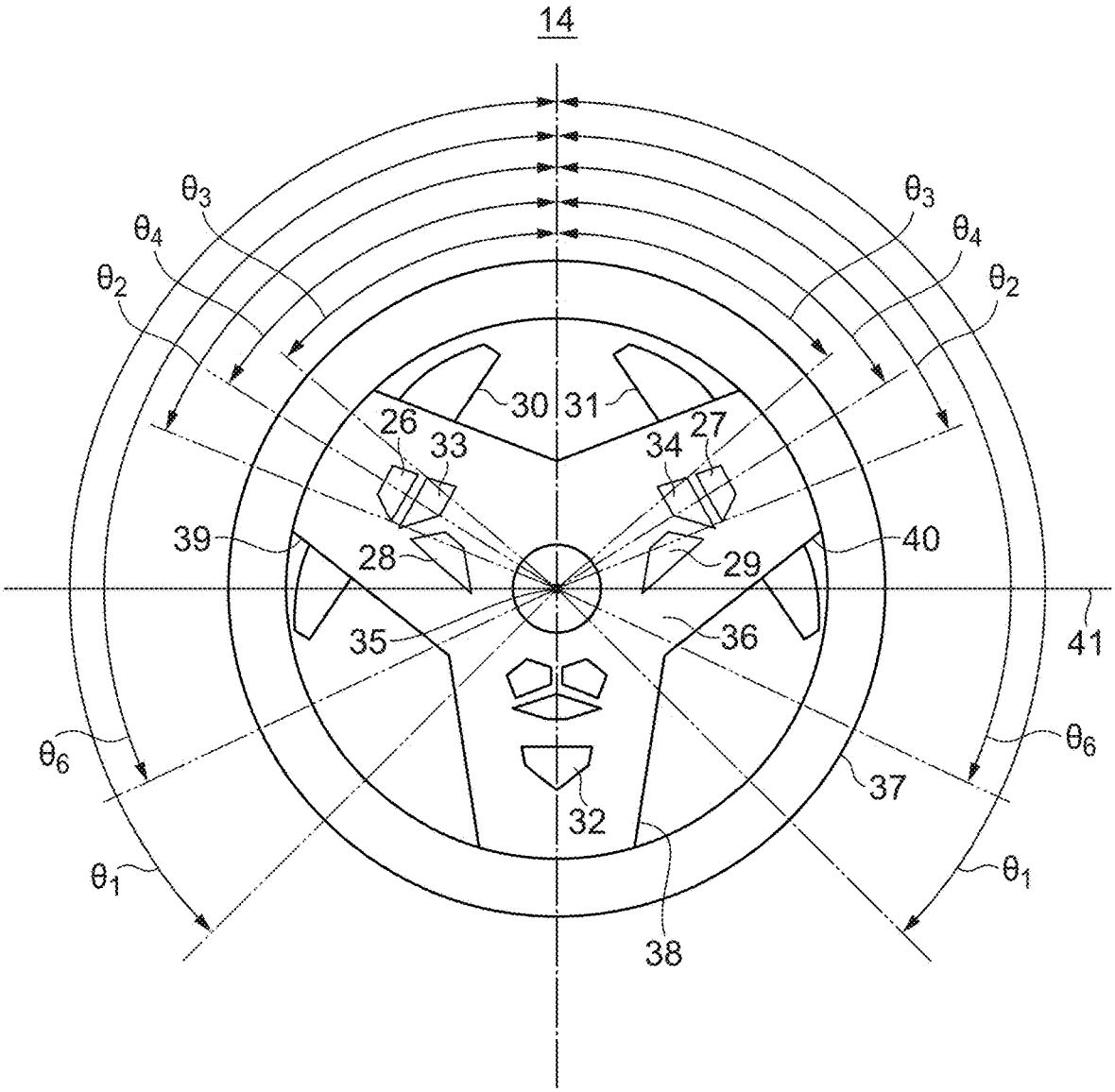
FIG. 6 is a view for explaining a configuration of a steering apparatus according to the first preferred embodiment of the present invention.

FIG. 6 is a view for explaining a configuration of the steering apparatus 14, and shows a case in which the steering apparatus 14 is viewed opposite from the side of the marine vessel operator. It should be noted that a vertical direction and a left/right direction of FIG. 6 correspond to a vertical direction and a left/right direction of the marine vessel 1, the depth side of FIG. 6 is the bow side of the marine vessel 1, and the front side of FIG. 6 is the stern side of the marine vessel 1.

As shown in FIG. 6, the steering apparatus 14 includes a central portion 36 that is supported rotatably around a rotation fulcrum 35 with respect to a column portion (not shown), the wheel portion 37 (a handle portion) that has an annular shape, and, for example, three spoke portions (spoke portions 38, 39, and 40) that connect the central portion 36 and the wheel portion 37.

In the steering apparatus 14, when the wheel portion 37 is at a position that makes the marine vessel 1 move straight ahead, that is, when a rotation angle of the wheel portion 37 is 0° (hereinafter, referred to as "a straight-ahead state"), the spoke portion 38 is positioned below a virtual plane 41 extending through the rotation fulcrum 35 and parallel to the left/right direction, and extends downward from the rotation fulcrum 35. In addition, when the wheel portion 37 is in the straight-ahead state, the spoke portion 39 is positioned above the virtual plane 41, and extends from the central portion 36 so as to be positioned within an angle range from about 0° to about 60°, for example, clockwise with respect to the virtual plane 41 in a circumferential direction about the rotation fulcrum 35, preferably, so as to be positioned within an angle range from about 20° to about 40°, for example, clockwise with respect to the virtual plane 41 in the circumferential direction about the rotation fulcrum 35. In addition, when the wheel portion 37 is in the straight-ahead state, the spoke portion 40 is positioned above the virtual plane 41, and extends from the central portion 36 so as to be positioned within an angle range from about 0° to about 60°, for example, counterclockwise with respect to the virtual plane 41 in the circumferential direction about the rotation fulcrum 35, preferably, so as to be positioned within an angle range from about 20° to about 40°, for example, counterclockwise with respect to the virtual plane 41 in the circumferential direction about the rotation fulcrum 35.

In the steering apparatus 14, the left lateral movement switch 26, the left pressing switch 33, and the pivot turning switch 28 are located on the spoke portion 39. In addition, the right lateral movement switch 27, the right pressing switch 34, and the RPM adjustment switch 29 are located on the spoke portion 40. Moreover, the enabled/disabled changeover switch 32 is located on the spoke portion 38.

The left paddle 30 is located closer to the bow side of the marine vessel 1 than the spoke portion 39 so as to overlap the spoke portion 39 when viewed from the marine vessel operator. The right paddle 31 is located closer to the bow side of the marine vessel 1 than the spoke portion 40 so as to overlap the spoke portion 40 when viewed from the marine vessel operator. The left paddle 30 and the right paddle 31 are freely rotatable (movable) in the front-rear direction. The left paddle 30 and the right paddle 31 are rotated forward (backward of the hull 2) with respect to initial positions by being operated by the marine vessel operator, and return to the initial positions when hands operating the left paddle 30 and the right paddle 31 are released. The left paddle 30 and the right paddle 31 rotate integrally with the wheel portion 37 around the rotation fulcrum 35.

In the high-speed navigating mode, the controller 21 changes the traveling direction of the marine vessel 1 in accordance with the rotation operation of the wheel portion 37. The steering apparatus 14 outputs an operation signal indicating the operation position of the wheel portion 37 to the controller 21. The controller 21 controls the steering actuators 22L and 22R in accordance with the operation of the wheel portion 37. That is, the controller 21 changes directions of the forward moving jetting ports 19L and 19R and the backward moving jetting ports 20L and 20R of the reverse buckets 10L and 10R in accordance with the rotation angle of the wheel portion 37. In the low-speed navigating mode, the controller 21 controls the marine vessel propulsion devices 4L and 4R based on the operation signals of the switches 26, 27, 28, 29, 33, and 34 and the operation signals of the paddles 30 and 31.

The left paddle 30 issues an instruction to cause a backward propulsive force to be applied to the hull 2, and the right paddle 31 issues an instruction to cause a forward propulsive force to be applied to the hull 2. In the low-speed navigating mode, the controller 21 makes a propulsive force corresponding to an operation amount of the left paddle 30 or an operation amount of the right paddle 31 act on the hull 2. At this time, the controller 21 changes the rotation number of the engine 3L or the rotation number of the engine 3R in accordance with the operation amount of the left paddle 30 or the operation amount of the right paddle 31. In addition, the functions of the switches 26, 27, 28, 29, 33, and 34 and the paddles 30 and 31 become enabled in the low-speed navigating mode.

The left lateral movement switch 26, the right lateral movement switch 27, the left pressing switch 33, and the right pressing switch 34 are mode switches that each selects or activates the lateral thrust generation mode. In particular, the left lateral movement switch 26 and the right lateral movement switch 27 are the mode switches that each selects or activates the lateral movement mode, and are switches that each continues to generate a propulsive force in the lateral direction with respect to the hull 2 while being operated by the marine vessel operator. The controller 21 controls the marine vessel propulsion device 4L or the marine vessel propulsion device 4R in accordance with an operation input to the left lateral movement switch 26 or an operation input to the right lateral movement switch 27 to execute the lateral movement mode.

The left pressing switch 33 and the right pressing switch 34 are the mode switches that each selects or activates the pressing mode, and are switches that each generates the propulsive force in the lateral direction with respect to the hull 2 in accordance with being operated by the marine vessel operator. The controller 21 controls the marine vessel propulsion device 4L or the marine vessel propulsion device 4R in accordance with an operation input to the left pressing switch 33 or an operation input to the right pressing switch 34 to execute the pressing mode.

The RPM adjustment switch 29 switches the rotation number of the engine 3L and the rotation number of the engine 3R between at least two stages (for example, low and high). Switching of the rotation number of the engine 3L and switching of the rotation number of the engine 3R are applied to each mode of the low-speed navigating modes. The stages of the rotation number of the engine 3L that are switchable and the stages of the rotation number of the engine 3R that are switchable are set in advance for each mode.

The enabled/disabled changeover switch 32 performs the switching between the high-speed navigating mode and the low-speed navigating mode in accordance with its operation. Therefore, the enabled/disabled changeover switch 32 enables/disables the functions of the switches 26, 27, 28, 29, 33, and 34 and the paddles 30 and 31 that become enabled in the low-speed navigating mode.

In the steering apparatus 14, an operable rotation angle of the wheel portion 37 in the high-speed navigating mode is set to a relatively large rotation angle θ1, and in the high-speed navigating mode, the wheel portion 37 is set to be able to rotated up to, for example, about 135° both clockwise and counterclockwise in FIG. 6 from the straight-ahead state. On the other hand, an operable rotation angle of the wheel portion 37 in the low-speed navigating mode is set to a relatively small rotation angle θ2, and in the low-speed navigating mode, the wheel portion 37 is set to be able to rotated up to, for example, about 67.5° both clockwise and counterclockwise in FIG. 6 from the straight-ahead state.

Figure 7A:
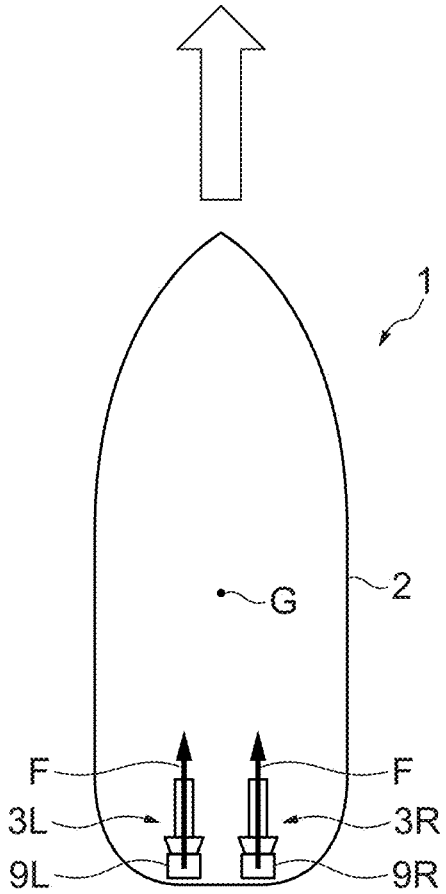
FIGS. 7A and 7B are figures for explaining a change in a traveling direction of the marine vessel that is a jet propulsion boat.
Figure 7B:
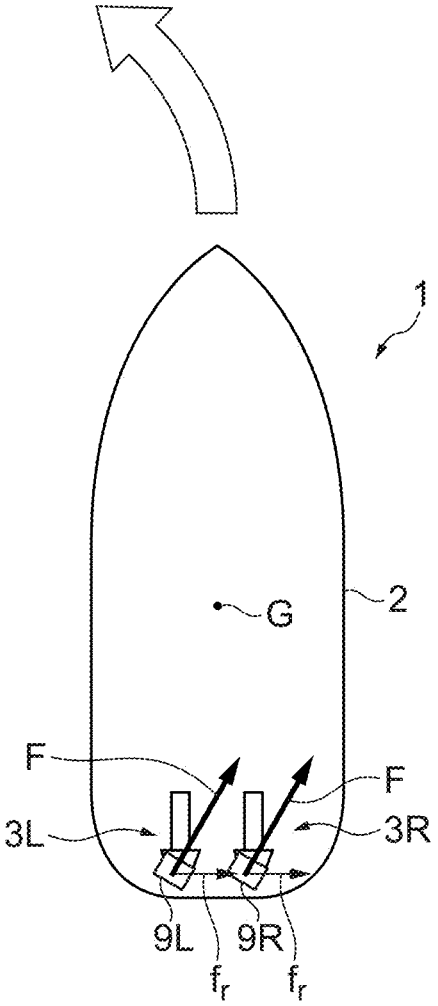

FIGS. 7A and 7B are figures for explaining a change in the traveling direction of the marine vessel 1 that is a jet propulsion boat. First, when the wheel portion 37 is not rotated and is in the straight-ahead state, since the controller 21 does not actuate the steering actuators 22L and 22R and does not change the direction of the deflectors 9L and 9R, the direction of the water jetted from the forward moving jetting port 19L and the direction of the water jetted from the forward moving jetting port 19R are not changed to the left or the right. As shown in FIG. 7A, a propulsive force F in the forward moving direction, which is generated by the recoil of the water jetted from the forward moving jetting port 19L of the deflector 9L and the recoil of the water jetted from the forward moving jetting port 19R of the deflector 9R, acts in a direction parallel to the front-rear direction of the hull 2, and as a result, the marine vessel 1 moves straight ahead forward (see a hollow arrow in FIG. 7A).

On the other hand, when the wheel portion 37 is rotated counterclockwise, the controller 21 actuates the steering actuators 22L and 22R and changes the direction of the deflectors 9L and 9R. Specifically, the steering actuators 22L and 22R rotationally move the deflectors 9L and 9R around the rotational axis line DL, respectively, so that the forward moving jetting ports 19L and 19R point leftward and backward. At this time, the direction of the water jetted from the forward moving jetting port 19L and the direction of the water jetted from the forward moving jetting port 19R are also changed to the left rear. As shown in FIG. 7B, the propulsive force F in the forward moving direction, which is generated by the recoil of the water jetted from the forward moving jetting port 19L of the deflector 9L and the recoil of the water jetted from the forward moving jetting port 19R of the deflector 9R, acts on the hull 2 diagonally forward right, a component force fr of the propulsive force F in the right direction of the hull 2 (hereinafter, referred to as "a rightward component force fr") generates a yaw moment that rotates the hull 2 to the left around the center of gravity of the hull 2. As a result, the traveling direction of the marine vessel 1 is changed to the left (see the hollow arrow in FIG. 7B).

It should be noted that although the case in which the traveling direction of the marine vessel 1 is changed to the left has been described with reference to FIGS. 7A and 7B, since the same processes are performed in the case in which the traveling direction of the marine vessel 1 is changed to the right, the description of the case in which the traveling direction of the marine vessel 1 is changed to the right is omitted.

However, as described above, in the marine vessel 1 that is a jet propulsion boat, since the traveling direction of the marine vessel 1 is changed (the marine vessel 1 turns) by the yaw moment generated due to the component force of the propulsive force F in the left direction or the right direction, in the case in which the propulsive force F is small, in particular, in the low-speed navigating mode, the yaw moment becomes small, and there is room for improvement in the turning performance of the marine vessel 1. Therefore, in the first preferred embodiment, in order to compensate for this issue, in the case in which the marine vessel 1 moves forward in the low-speed navigating mode, when a predetermined condition is satisfied, the controller 21 executes a turning assist control, which increases the propulsive force F to increase the yaw moment, to improve the turning performance of the marine vessel 1. Therefore, a rotatable range of the wheel portion 37 in the low-speed navigating mode is provided with regions where the propulsive force F is increased. Specifically, for each of clockwise and counterclockwise, a bucket full-open angle θ3 (a first threshold) and an engine rotation number increasing angle θ4 (a second threshold) are set within the rotatable range of the wheel portion 37 in the low-speed navigating mode. Here, the engine rotation number increasing angle θ4 is larger than the bucket full-open angle θ3 and is smaller than the operable rotation angle θ2 in the low-speed navigating mode.

Figure 8A:
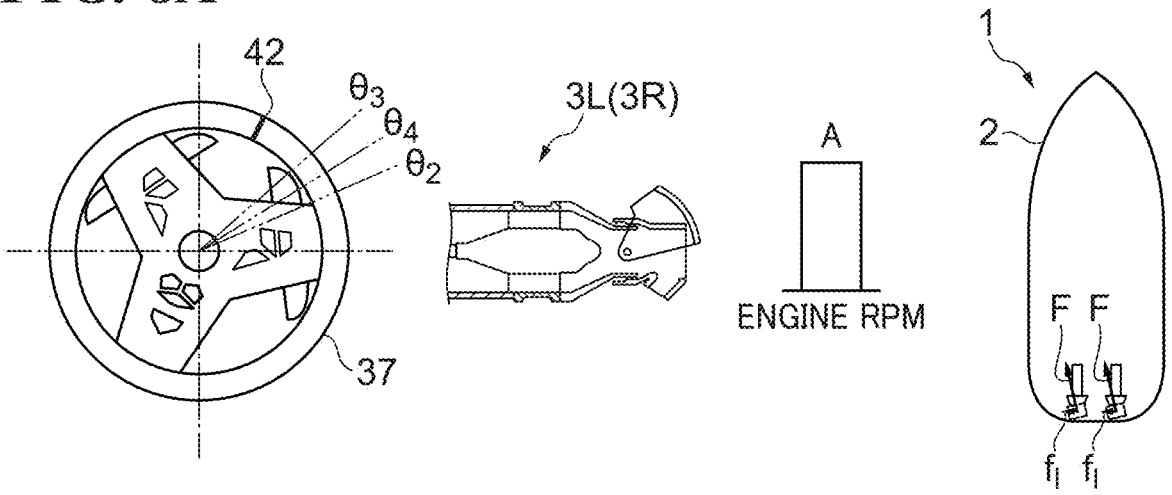
FIGS. 8A, 8B, and 8C are figures for explaining a turning assist control executed in the first preferred embodiment of the present invention.
Figure 8B:
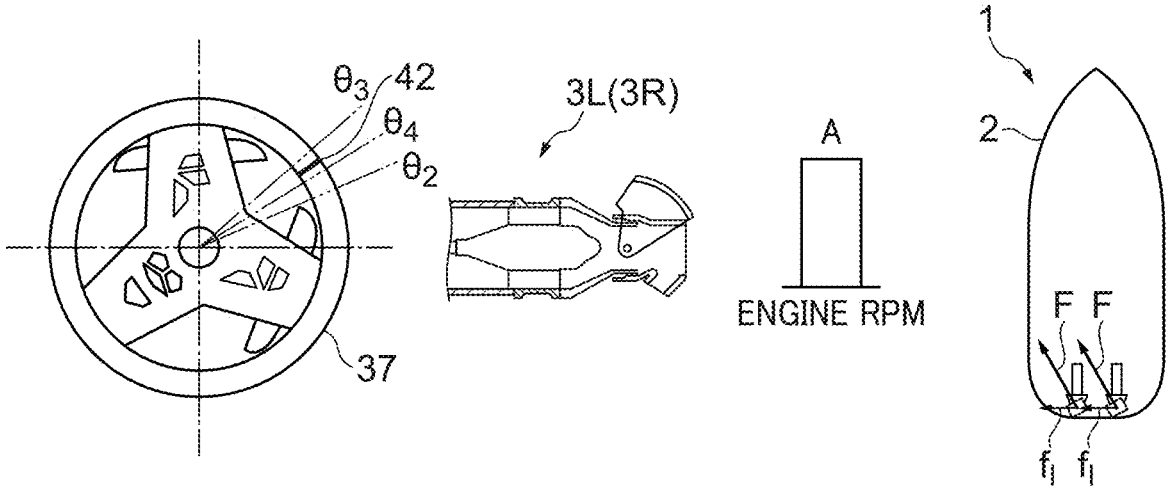
Figure 8C:
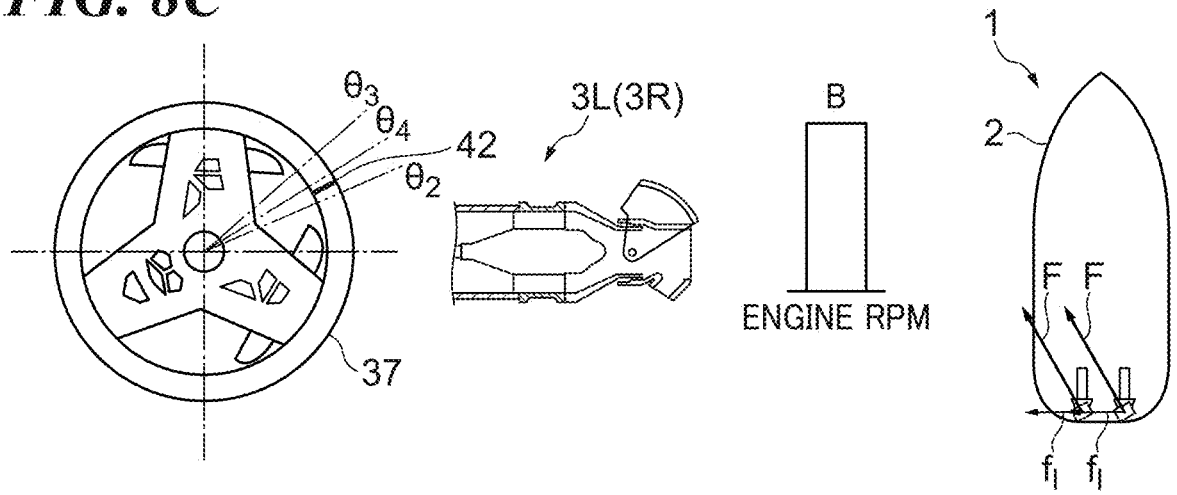

FIGS. 8A, 8B, and 8C are figures for explaining the turning assist control executed in the first preferred embodiment of the present invention. It should be noted that in FIGS. 8A, 8B, and 8C, in order to facilitate understanding of the rotation angle of the wheel portion 37, a position 42 indicating the 12 o'clock direction of the wheel portion 37 in the straight-ahead state (hereinafter, referred to as "a reference position 42") is indicated by a black line. In FIGS. 8A, 8B, and 8C, it is assumed that the marine vessel 1 is set to the low-speed navigating mode, the bucket opening is set to 70% (see FIG. 5C), and the wheel portion 37 is rotated clockwise.

First, as shown in FIG. 8A, in the case in which the rotation angle of the wheel portion 37 is equal to or less than the bucket full-open angle θ3, since the wheel portion 37 is not largely rotated, it is considered that an intention of the marine vessel operator is to not largely change the traveling direction of the marine vessel 1. Therefore, in particular, the propulsive force F is not increased in order to improve the turning performance of the marine vessel 1. Specifically, the controller 21 actuates the steering actuators 22L and 22R in accordance with the rotation operation of the wheel portion 37 to change the directions of the deflectors 9L and 9R so that the forward moving jetting ports 19L and 19R point rightward and backward, but maintains the bucket opening at 70%, which is the bucket opening in the low-speed navigating mode, and maintains the rotation number of the engine 3L and the rotation number of the engine 3R at a rotation number A corresponding to the operation amounts of the throttle levers 15L and 15R. Therefore, since the amount of the water jetted backward of the hull 2 from the forward moving jetting ports 19L and 19R does not particularly increase and the propulsive force F in the forward moving direction generated by the recoil of the water jetted from the forward moving jetting ports 19L and 19R does not increase either, a component force fl of the propulsive force F in the left direction of the hull 2 (hereinafter, referred to as "a leftward component force fl") does not increase. As a result, the yaw moment to turn the hull 2 to the right does not become particularly large, and the traveling direction of the marine vessel 1 gently changes to the right.

On the other hand, in the case in which the wheel portion 37 is further rotated and as shown in FIG. 8B, the rotation angle of the wheel portion 37 becomes larger than the bucket full-open angle θ3, since it is considered that the intention of the marine vessel operator is to largely change the traveling direction of the marine vessel 1, the propulsive force F is increased in order to improve the turning performance of the marine vessel 1. Specifically, the controller 21 changes the directions of the deflectors 9L and 9R so that the forward moving jetting ports 19L and 19R point farther rightward and backward in accordance with the rotation operation of the wheel portion 37, changes the bucket opening to 100%, and actuates the shift actuators 23L and 23R to rotationally move the deflectors 9L and 9R upward to the fully open position. Therefore, since the amount of the water jetted backward of the hull 2 from the forward moving jetting ports 19L and 19R increases and the propulsive force F in the forward moving direction generated by the recoil of the water jetted from the forward moving jetting ports 19L and 19R also increases, the leftward component force fl increases. As a result, the yaw moment to turn the hull 2 to the right increases, and the traveling direction of the marine vessel 1 changes quickly to the right.

It should be noted that the controller 21 maintains the rotation number of the engine 3L and the rotation number of the engine 3R at the rotation number A corresponding to the operation amounts of the throttle levers 15L and 15R while the rotation angle of the wheel portion 37 is equal to or less than the engine rotation number increasing angle θ4.

In the case in which the wheel portion 37 is further rotated clockwise and as shown in FIG. 8C, the rotation angle of the wheel portion 37 becomes larger than the engine rotation number increasing angle θ4, since it is considered that the intention of the marine vessel operator is to largely change the traveling direction of the marine vessel 1, the propulsive force F is further increased in order to further improve the turning performance of the marine vessel 1. Specifically, the controller 21 changes the directions of the deflectors 9L and 9R so that the forward moving jetting ports 19L and 19R point even more rightward and backward in accordance with the rotation operation of the wheel portion 37, and increases the rotation number of the engine 3L and the rotation number of the engine 3R to a rotation number B higher than the rotation number A corresponding to the operation amounts of the throttle levers 15L and 15R while maintaining the bucket opening at 100%. As a result, since the amount of the water jetted backward of the hull 2 from the forward moving jetting ports 19L and 19R further increases and the propulsive force F in the forward moving direction generated by the recoil of the water jetted from the forward moving jetting ports 19L and 19R also further increases, the leftward component force fl further increases. As a result, the yaw moment to turn the hull 2 to the right further increases, and the traveling direction of the marine vessel 1 changes to the right even more quickly.

It should be noted that although the case in which the wheel portion 37 is rotated clockwise has been described with reference to FIGS. 8A, 8B, and 8C, the same processes are performed in the case in which the wheel portion 37 is rotated counterclockwise.

Figure 9:
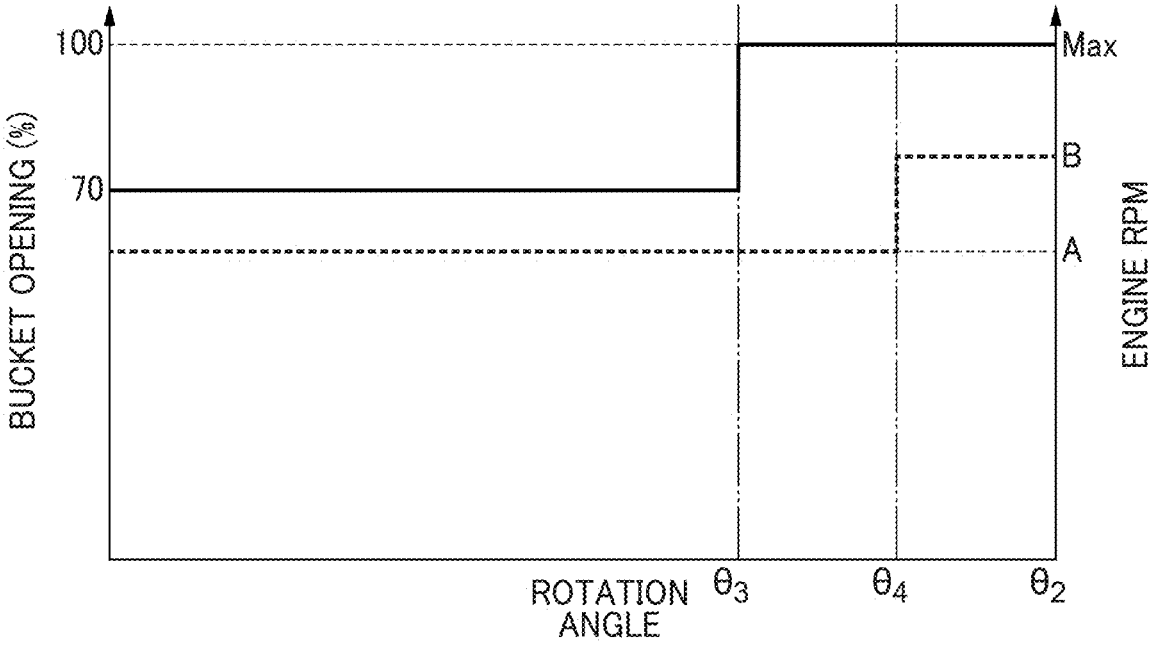
FIG. 9 is a graph that shows a relationship between a rotation angle of a wheel portion, a bucket opening, and a rotation number of an engine in the turning assist control according to the first preferred embodiment of the present invention.

FIG. 9 is a graph that shows a relationship between the rotation angle of the wheel portion 37, the bucket opening, and the rotation number of the engines 3L and 3R in the turning assist control according to the first preferred embodiment of the present invention. In FIG. 9, a solid line indicates the bucket opening, and a dashed line indicates the rotation number of the engines 3L and 3R.

As shown in FIG. 9, in the case in which the rotation angle of the wheel portion 37 (both clockwise and counterclockwise) is equal to or less than the bucket full-open angle θ3, the bucket opening is maintained at 70%, and the rotation number of the engines 3L and 3R is also maintained at the rotation number A corresponding to the operation amounts of the throttle levers 15L and 15R.

After that, when the rotation angle of the wheel portion 37 increases and exceeds the bucket full-open angle θ3, the bucket opening is changed to 100%. Then, when the rotation angle of the wheel portion 37 further increases and exceeds the engine rotation number increasing angle θ4, the rotation number of the engines 3L and 3R is increased to the rotation number B higher than the rotation number A corresponding to the operation amounts of the throttle levers 15L and 15R.

Since the marine vessel 1 is set to the low-speed navigating mode, the increased rotation number B is lower than the maximum rotation number Max of the engines 3L and 3R. As a result, it is possible to avoid in the low-speed navigating mode, in which the sound of cutting waves and the sound of the wind become relatively small, that the operating sound of the engines 3L and 3R becomes relatively loud and passengers of the marine vessel 1 feel uncomfortable.

In the first preferred embodiment, the bucket full-open angle θ3 and the engine rotation number increasing angle θ4 are set only in the low-speed navigating mode, and the bucket full-open angle θ3 and the engine rotation number increasing angle θ4 are not set in the high-speed navigating mode. Therefore, when the marine vessel operator does not want to improve the turning performance of the marine vessel 1, by operating the enabled/disabled changeover switch 32, the marine vessel operator is able to shift the marine vessel 1 to the high-speed navigating mode and forcibly eliminate the bucket full-open angle θ3 and the engine rotation number increasing angle θ4.

According to the first preferred embodiment, when the rotation angle of the wheel portion 37 becomes larger than the bucket full-open angle θ3 in a state where the marine vessel 1 is shifted to the low-speed navigating mode and the bucket opening becomes 70%, the bucket opening is changed to 100% and the deflectors 9L and 9R rotationally move to the fully open position, and further, when the rotation angle of the wheel portion 37 becomes larger than the engine rotation number increasing angle θ4, the rotation number of the engines 3L and 3R is increased. As a result, since the amount of the water jetted from the forward moving jetting port 19L of the deflector 9L whose direction is changed and the amount of the water jetted from the forward moving jetting port 19R of the deflector 9R whose direction is changed increase in accordance with the rotation angle of the wheel portion 37 and the propulsive force F in the forward moving direction increases, the rightward component force fr or the leftward component force fl of the propulsive force F also increases, and the yaw moment that rotates the hull 2 around the center of gravity of the hull 2 increases. That is, in order to increase the yaw moment to turn the marine vessel 1, since it is not necessary to change an acting direction of the propulsive force F of one of the marine vessel propulsion devices 4L and 4R to the backward moving direction, it is possible to reduce the feeling of deceleration felt by the passengers, and as a result, it is possible to improve the riding comfort when the marine vessel 1 turns.

In the first preferred embodiment, in order to increase the propulsive force F, the deflectors 9L and 9R are rotationally moved upward (the bucket opening is increased) prior to the increase in the rotation number of the engines 3L and 3R. Therefore, when the marine vessel operator increases the rotation angle of the wheel portion 37 to improve the turning performance of the marine vessel 1, it is possible to prevent the sudden increase in the operating sound of the engines 3L and 3R, and it is possible to avoid making the passengers of the marine vessel 1 feel uncomfortable.

In the first preferred embodiment, as shown in FIG. 9, when the rotation angle of the wheel portion 37 exceeds the bucket full-open angle θ3, the bucket opening is suddenly increased from 70% to 100%, and when the rotation angle of the wheel portion 37 exceeds the engine rotation number increasing angle θ4, the rotation number of the engines 3L and 3R is increased suddenly from the rotation number A to the rotation number B. However, the bucket opening and the rotation number of the engines 3L and 3R may be changed gradually.

Figure 10A:
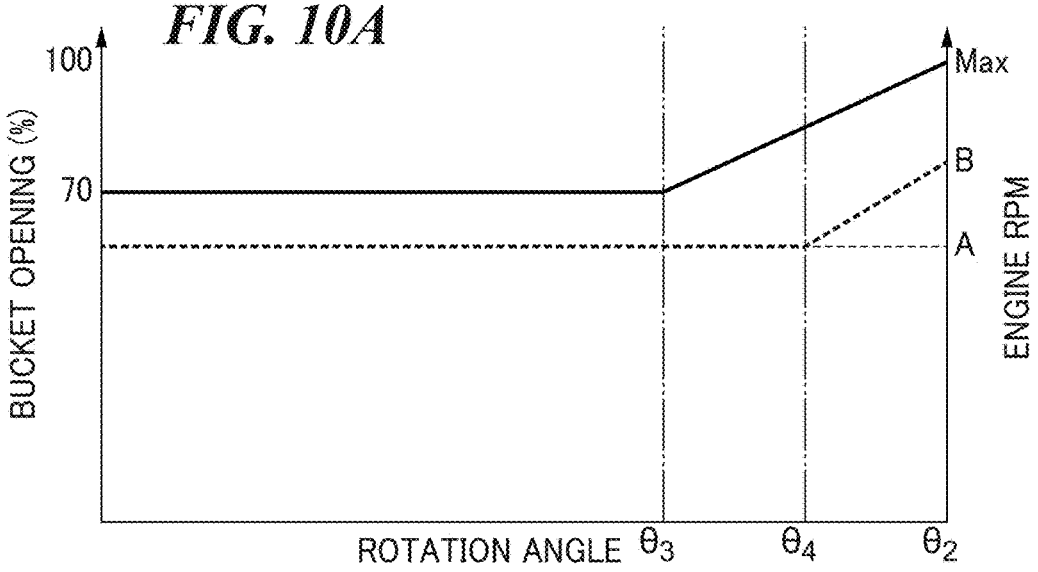
FIGS. 10A, 10B, and 10C are graphs that each shows a relationship between the rotation angle of the wheel portion, the bucket opening, and the rotation number of the engine in a first modification example of the turning assist control according to the first preferred embodiment of the present invention.
Figure 10B:
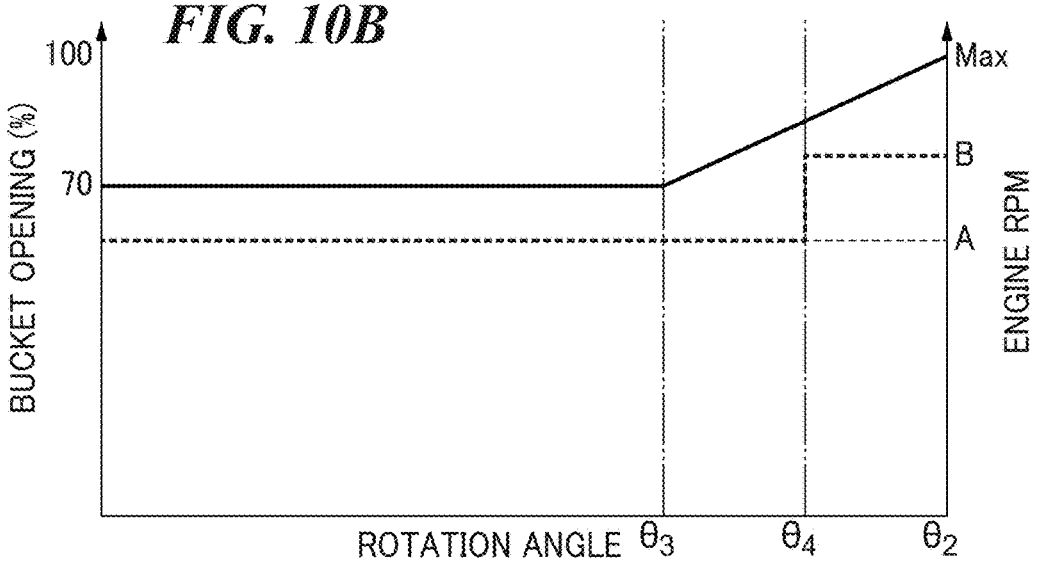
Figure 10C:
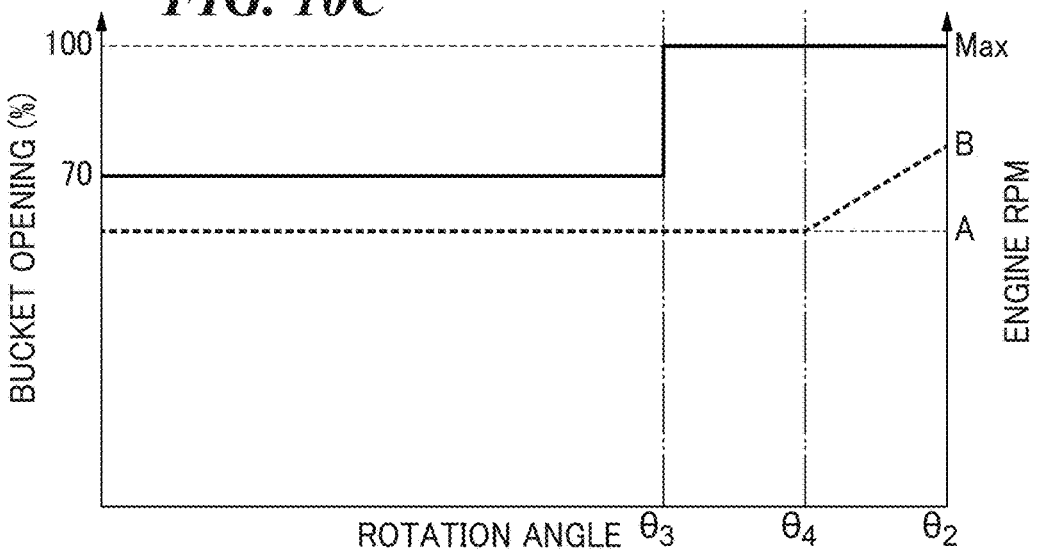

FIGS. 10A, 10B, and 10C are graphs that each shows a relationship between the rotation angle of the wheel portion 37, the bucket opening, and the rotation number of the engines 3L and 3R in a first modification example of the turning assist control according to the first preferred embodiment of the present invention. In each of FIGS. 10A, 10B, and 10C, a solid line indicates the bucket opening, and a dashed line indicates the rotation number of the engines 3L and 3R.

For example, as shown in FIG. 10A, when the rotation angle of the wheel portion 37 exceeds the bucket full-open angle θ3, the controller 21 may increase the bucket opening (may reduce the amount by which the reverse bucket 10L covers the forward moving jetting port 19L and the amount by which the reverse bucket 10R covers the forward moving jetting port 19R) as the rotation angle of the wheel portion 37 increases, and when the rotation angle of the wheel portion 37 exceeds the engine rotation number increasing angle θ4, the controller 21 may increase the rotation number of the engines 3L and 3R as the rotation angle of the wheel portion 37 increases.

Furthermore, as shown in FIG. 10B, when the rotation angle of the wheel portion 37 exceeds the bucket full-open angle θ3, although the controller 21 increases the bucket opening as the rotation angle of the wheel portion 37 increases, and when the rotation angle of the wheel portion 37 exceeds the engine rotation number increasing angle θ4, the controller 21 may increase the rotation number of the engines 3L and 3R suddenly from the rotation number A to the rotation number B.

Moreover, as shown in FIG. 10C, when the rotation angle of the wheel portion 37 exceeds the bucket full-open angle θ3, although the controller 21 increases the bucket opening suddenly from 70% to 100%, and when the rotation angle of the wheel portion 37 exceeds the engine rotation number increasing angle θ4, the controller 21 may increase the rotation number of the engines 3L and 3R as the rotation angle of the wheel portion 37 increases.

In FIGS. 10A, 10B, and 10C, since at least one of the bucket opening and the rotation number of the engines 3L and 3R does not change suddenly, not only the propulsive force F increases gently, but also the yaw moment to turn the hull 2 increases gently. As a result, it is possible to further improve the riding comfort when the marine vessel 1 turns.

In the first preferred embodiment, although the increase of the bucket opening and the increase of the rotation number of the engines 3L and 3R are performed at different timings, the increase of the bucket opening and the increase of the rotation number of the engines 3L and 3R may be performed at the same timing.

Figure 11A:
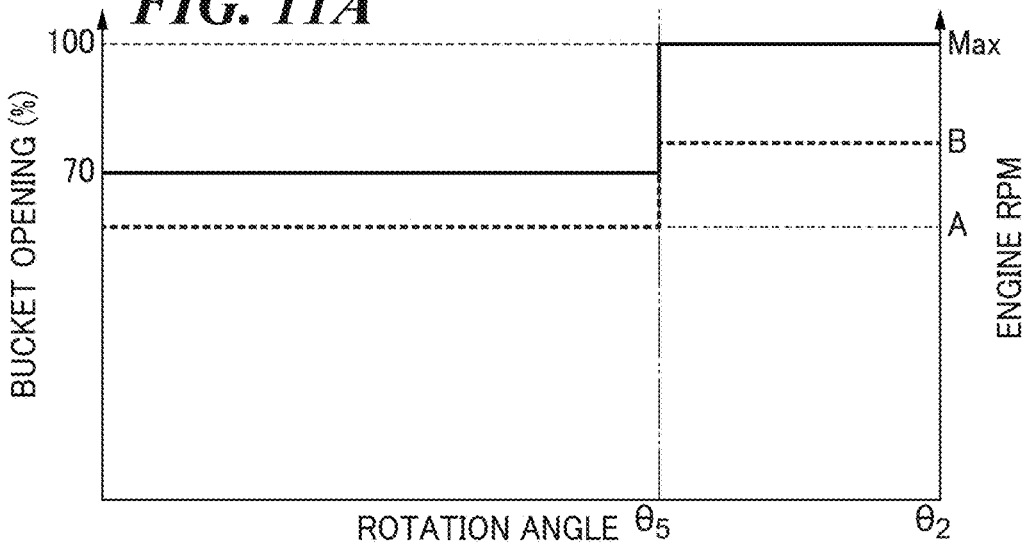
FIGS. 11A, 11B, and 11C are graphs that each shows a relationship between the rotation angle of the wheel portion, the bucket opening, and the rotation number of the engine in a second modification example of the turning assist control according to the first preferred embodiment of the present invention.
Figure 11B:
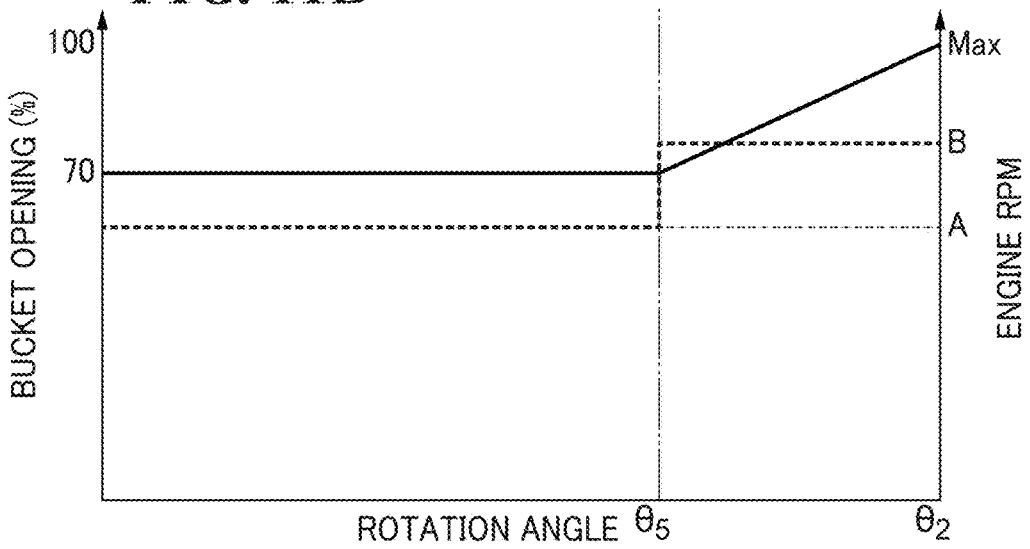
Figure 11C:
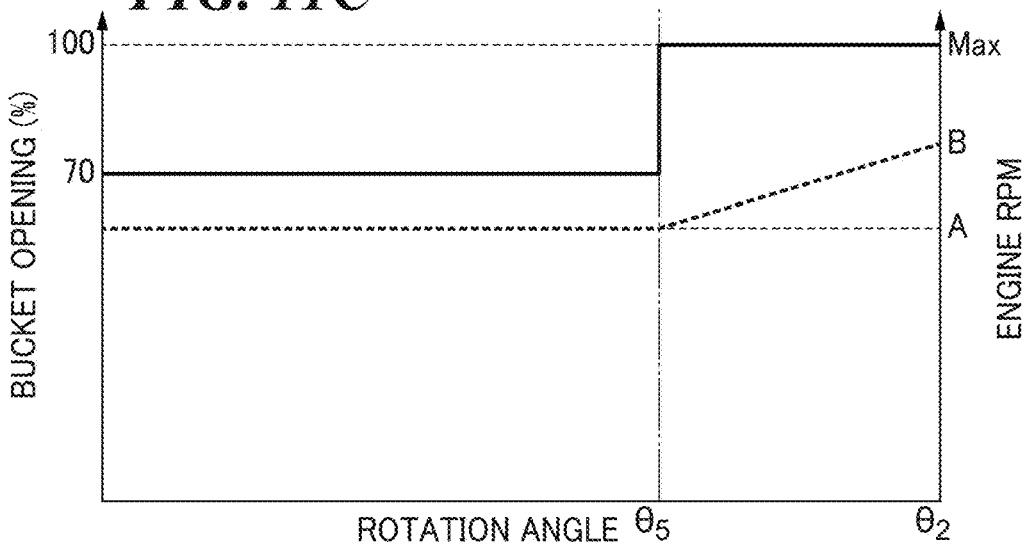

FIGS. 11A, 11B, and 11C are graphs that each shows a relationship between the rotation angle of the wheel portion 37, the bucket opening, and the rotation number of the engines 3L and 3R in a second modification example of the turning assist control according to the first preferred embodiment of the present invention. In each of FIGS. 11A, 11B, and 11C, a solid line indicates the bucket opening, and a dashed line indicates the rotation number of the engines 3L and 3R.

For example, as shown in FIG. 11A, when the rotation angle of the wheel portion 37 exceeds a thrust increasing angle θ5 (a first threshold), the controller 21 may increase the bucket opening suddenly from 70% to 100% and increase the rotation number of the engines 3L and 3R suddenly from the rotation number A to the rotation number B.

Furthermore, as shown in FIG. 11B, when the rotation angle of the wheel portion 37 exceeds the thrust increasing angle θ5, although the controller 21 increases the bucket opening as the rotation angle of the wheel portion 37 increases, the controller 21 may increase the rotation number of the engines 3L and 3R suddenly from the rotation number A to the rotation number B.

As shown in FIG. 11C, when the rotation angle of the wheel portion 37 exceeds the thrust increasing angle θ5, although the controller 21 increases the bucket opening suddenly from 70% to 100%, the controller 21 may increase the rotation number of the engines 3L and 3R as the rotation angle of the wheel portion 37 increases.

It should be noted that the above-described bucket opening in the case in which the throttle lever 15L is moved to the neutral position (35%), the above-described bucket opening in the case in which the throttle lever 15L is moved in the forward moving direction in low-speed navigating mode (70%), and the above-described bucket opening in the case in which the throttle lever 15L is moved in the forward moving direction in high-speed navigating mode (100%) are only examples, and the bucket opening is able to take different values depending on the specifications of the marine vessel 1.

Figure 12:
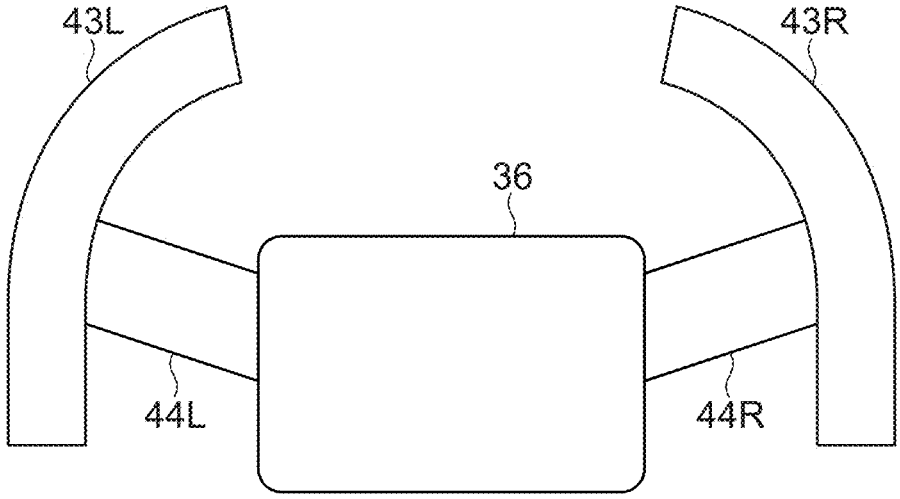
FIG. 12 is a view for explaining a configuration of a modification example of the steering apparatus according to the first preferred embodiment of the present invention.

In the first preferred embodiment, although the steering apparatus 14 includes the wheel portion 37 having the annular shape, instead of the wheel portion 37 having the annular shape, a steering apparatus may be provided with handlebars 43R and 43L that are located on the right and the left, respectively (see FIG. 12). In this case, the handlebar 43R is connected to the central portion 36 by a spoke portion 44R, and the handlebar 43L is connected to the central portion 36 by a spoke portion 44L. Also in this steering apparatus, the bucket full-open angle θ3 and the engine rotation number increasing angle θ4 are set in the same manner as in the steering apparatus 14. It should be noted that the illustrations of the switches 26, 27, 28, 29, 32, 33, and 34, and the paddles 30 and 31 are omitted in FIG. 12.

Next, a second preferred embodiment of the present invention will be described. A difference between the second preferred embodiment and the first preferred embodiment is that in the second preferred embodiment, a turning assist control is executed in the high-speed navigating mode instead of in the low-speed navigating mode, and in the turning assist control, the bucket opening is not changed and only the rotation number of the engines 3L and 3R is changed. Except for this difference, the components, operations, and effects of the second preferred embodiment are basically the same as those of the first preferred embodiment described above, so the description of duplicated components, operations, and effects will be omitted, and different components, operations, and effects will be described below.

In the second preferred embodiment, in the case in which the marine vessel 1 moves forward in the high-speed navigating mode, in order to execute the turning assist control, a rotatable range of the wheel portion 37 in the high-speed navigating mode is provided with regions where the propulsive force F is increased. Specifically, as shown in FIG. 6, for each of clockwise and counterclockwise, another engine rotation number increasing angle θ6 (a predetermined threshold) is set within the rotatable range of the wheel portion 37 in the high-speed navigating mode. Here, the engine rotation number increasing angle θ6 is smaller than the operable rotation angle θ1 in the high-speed navigating mode.

Figure 13A:
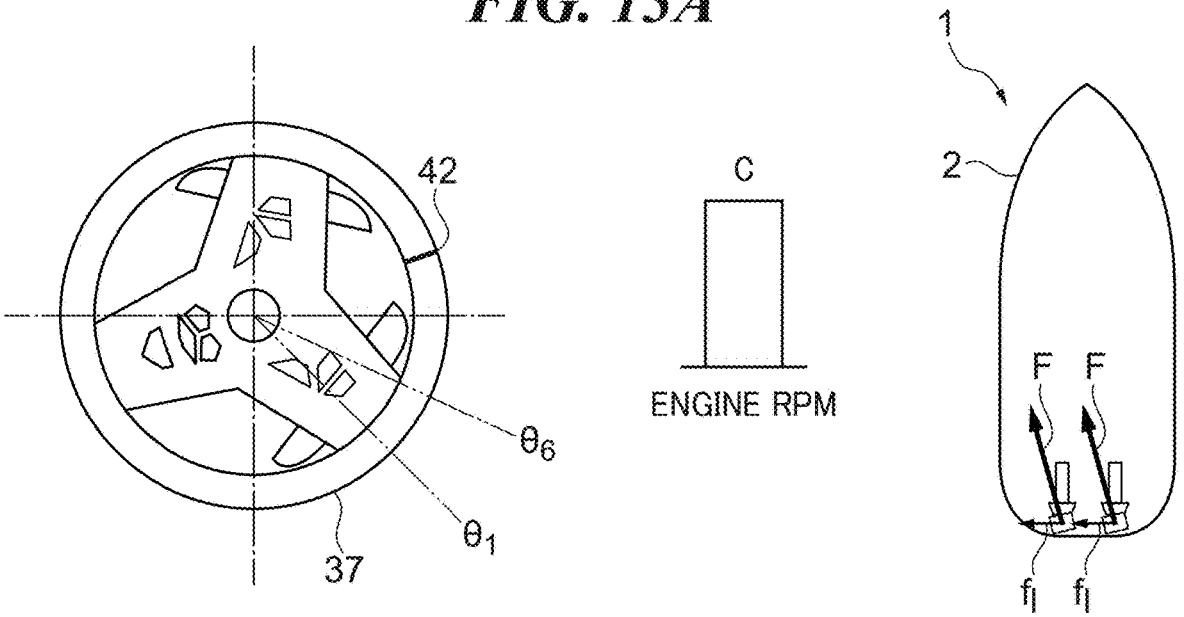
FIGS. 13A and 13B are figures for explaining a turning assist control executed in a second preferred embodiment of the present invention.
Figure 13B:
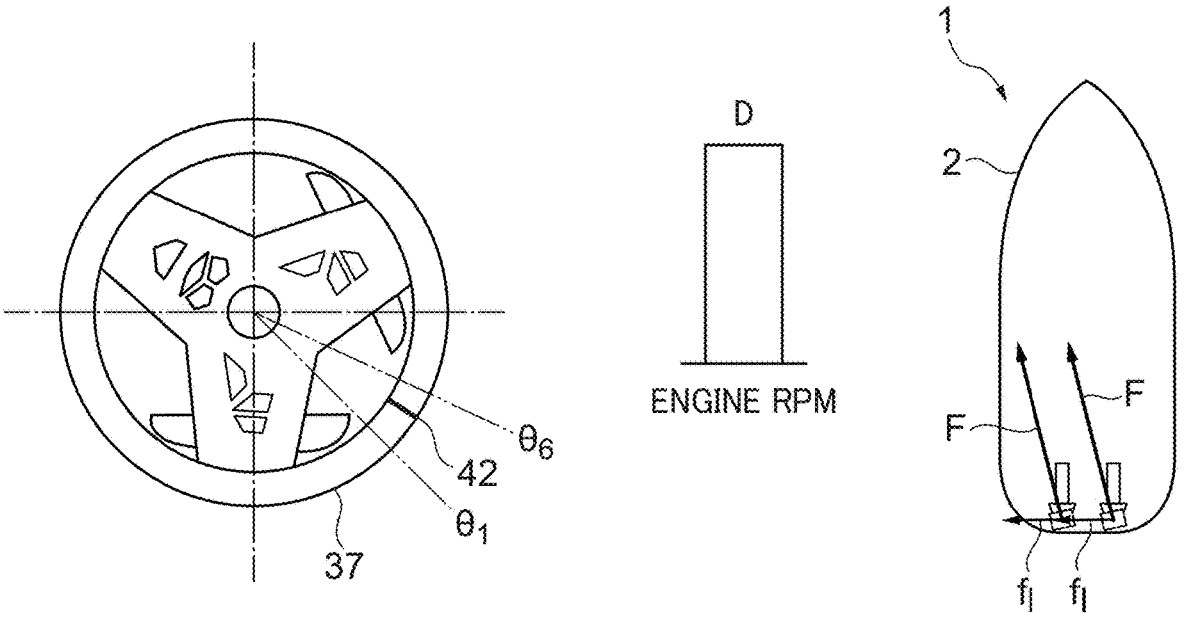

FIGS. 13A and 13B are figures for explaining the turning assist control executed in the second preferred embodiment of the present invention. In FIGS. 13A and 13B, it is assumed that the marine vessel 1 is set to the high-speed navigating mode, the bucket opening is set to 100% (see FIG. 5D), and the wheel portion 37 is rotated clockwise.

First, as shown in FIG. 13A, in the case in which the rotation angle of the wheel portion 37 is equal to or less than the engine rotation number increasing angle θ6, the propulsive force F is not increased in order to improve the turning performance of the marine vessel 1. Specifically, the controller 21 changes the directions of the deflectors 9L and 9R so that the forward moving jetting ports 19L and 19R point rightward and backward, but maintains the rotation number of the engine 3L and the rotation number of the engine 3R at a rotation number C corresponding to the operation amounts of the throttle levers 15L and 15R. Therefore, since the amount of the water jetted backward of the hull 2 from the forward moving jetting ports 19L and 19R does not particularly increase and a propulsive force F in the forward moving direction generated by the recoil of the water jetted from the forward moving jetting ports 19L and 19R does not increase either, a leftward component force fl of the propulsive force F does not increase. As a result, the yaw moment to rotate the hull 2 to the right does not become particularly large, and the traveling direction of the marine vessel 1 gently changes to the right.

On the other hand, in the case in which the wheel portion 37 is further rotated and as shown in FIG. 13B, the rotation angle of the wheel portion 37 becomes larger than the engine rotation number increasing angle θ6, since it is considered that the intention of the marine vessel operator is to largely change the traveling direction of the marine vessel 1, the propulsive force F is increased in order to improve the turning performance of the marine vessel 1. Specifically, the controller 21 changes the directions of the deflectors 9L and 9R so that the forward moving jetting ports 19L and 19R point farther rightward and backward in accordance with the rotation operation of the wheel portion 37, and increases the rotation number of the engine 3L and the rotation number of the engine 3R to a rotation number D higher than the rotation number C corresponding to the operation amounts of the throttle levers 15L and 15R. As a result, since the amount of the water jetted backward of the hull 2 from the forward moving jetting ports 19L and 19R increases and the propulsive force F in the forward moving direction generated by the recoil of the water jetted from the forward moving jetting ports 19L and 19R also increases, the leftward component force fl increases. As a result, the yaw moment to rotate the hull 2 to the right increases, and the traveling direction of the marine vessel 1 changes efficiently to the right.

It should be noted that although the case in which the wheel portion 37 is rotated clockwise has been described with reference to FIGS. 13A and 13B, the same processes are performed in the case in which the wheel portion 37 is rotated counterclockwise.

Figure 14:
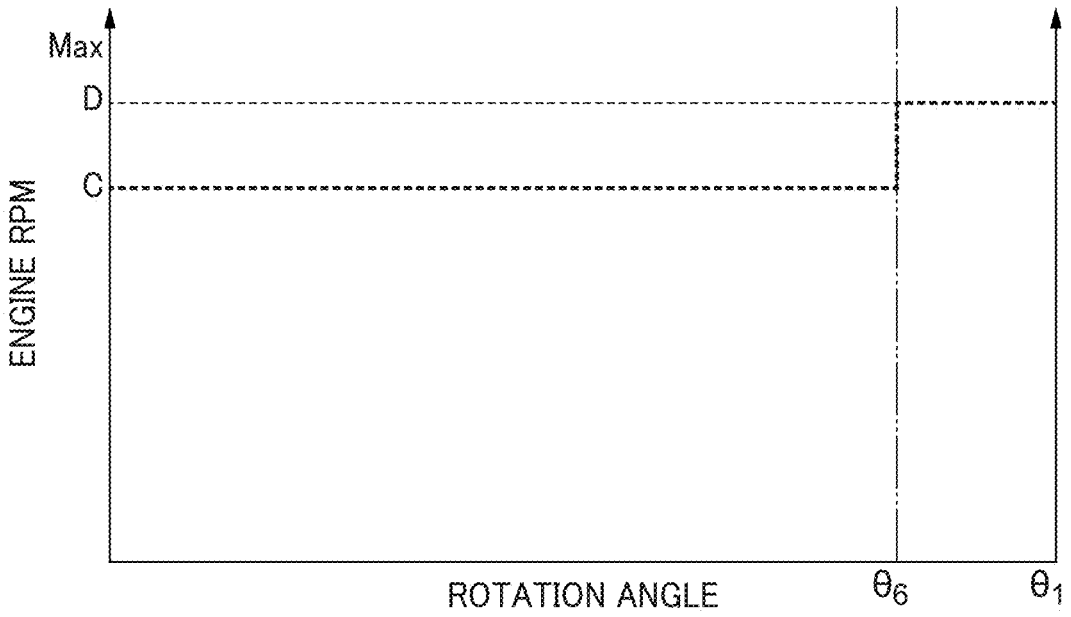
FIG. 14 is a graph that shows a relationship between the rotation angle of the wheel portion and the rotation number of the engine in the turning assist control according to the second preferred embodiment of the present invention.

FIG. 14 is a graph that shows a relationship between the rotation angle of the wheel portion 37 and the rotation number of the engines 3L and 3R in the turning assist control according to the second preferred embodiment of the present invention. In FIG. 14, a dashed line indicates the rotation number of the engines 3L and 3R.

As shown in FIG. 14, in the case in which the rotation angle of the wheel portion 37 (both clockwise and counterclockwise) is equal to or less than the engine rotation number increasing angle θ6, the rotation number of the engines 3L and 3R is maintained at the rotation number C corresponding to the operation amounts of the throttle levers 15L and 15R.

After that, when the rotation angle of the wheel portion 37 increases and exceeds the engine rotation number increasing angle θ6, the rotation number of the engines 3L and 3R is increased to the rotation number D higher than the rotation number C corresponding to the operation amounts of the throttle levers 15L and 15R.

According to the second preferred embodiment, when the rotation angle of the wheel portion 37 becomes larger than the engine rotation number increasing angle θ6 in a state where the marine vessel 1 is shifted to the high-speed navigating mode and the bucket opening becomes 100%, the rotation number of the engines 3L and 3R is increased. As a result, since the amount of the water jetted from the forward moving jetting port 19L of the deflector 9L whose direction is changed and the amount of the water jetted from the forward moving jetting port 19R of the deflector 9R whose direction is changed increase in accordance with the rotation angle of the wheel portion 37 and the propulsive force F in the forward moving direction increases, the rightward component force fr or the leftward component force fl of the propulsive force F also increases, and the yaw moment that rotates the hull 2 around the center of gravity of the hull 2 increases. That is, in order to increase the yaw moment to turn the marine vessel 1, since it is not necessary to change an acting direction of the propulsive force F of the marine vessel propulsion devices 4L and 4R to the backward moving direction, it is possible to reduce the feeling of deceleration felt by the passengers, and as a result, it is possible to improve the riding comfort when the marine vessel 1 turns.

In the second preferred embodiment, since the marine vessel 1 is set to the high-speed navigating mode and the sound of cutting waves and the sound of the wind become relatively loud, even in the case in which the operating sound of the engines 3L and 3R becomes loud, the discomfort of the passengers of the marine vessel 1 does not increase. Therefore, the maximum rotation number Max of the engines 3L and 3R may be set as the rotation number D.

In the second preferred embodiment, when the rotation angle of the wheel portion 37 exceeds the engine rotation number increasing angle θ6, the rotation number of the engines 3L and 3R is increased suddenly from the rotation number C to the rotation number D. However, the rotation number of the engines 3L and 3R may be changed gradually.

Figure 15:
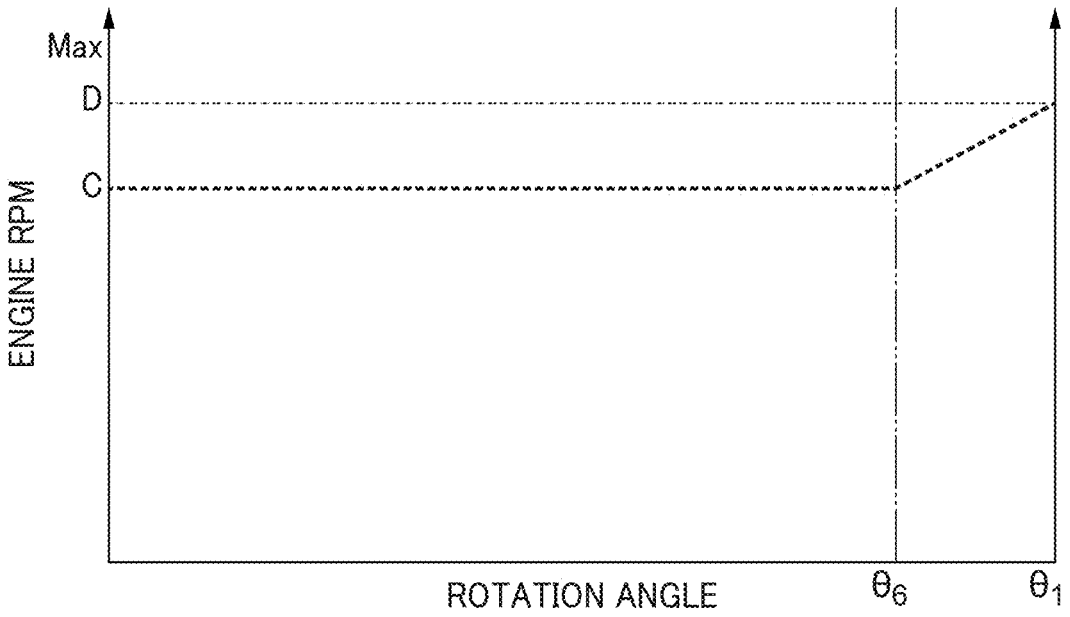
FIG. 15 is a graph that shows a relationship between the rotation angle of the wheel portion and the rotation number of the engine in a modification example of the turning assist control according to the second preferred embodiment of the present invention.

FIG. 15 is a graph that shows a relationship between the rotation angle of the wheel portion 37 and the rotation number of the engines 3L and 3R in a modification example of the turning assist control according to the second preferred embodiment of the present invention. In FIG. 15, a dashed line indicates the rotation number of the engines 3L and 3R. In FIG. 15, when the rotation angle of the wheel portion 37 exceeds the engine rotation number increasing angle θ6, the controller 21 increases the rotation number of the engines 3L and 3R as the rotation angle of the wheel portion 37 increases.

In FIG. 15, since the rotation number of the engines 3L and 3R does not change suddenly, not only the propulsive force F increases gently, but also the yaw moment to turn the hull 2 increases gently. As a result, it is possible to further improve the riding comfort when the marine vessel 1 turns.

In the second preferred embodiment, when the rotation angle of the wheel portion 37 exceeds the engine rotation number increasing angle θ6, although both the rotation number of the engine 3L and the rotation number of the engine 3R are increased, only one of the rotation number of the engine 3L and the rotation number of the engine 3R may be increased.

For example, when the marine vessel 1 is navigating not at a high speed but at a medium speed, for example, at a speed of around 20 knots even in the high-speed navigating mode, since the propulsive force F of the marine vessel propulsion devices 4L and 4R is not so large, the yaw moment generated at this time point is also not so large, and the turning performance of the marine vessel 1 is not high. Therefore, in the turning assist control, in order to improve the turning performance of the marine vessel 1, it is necessary to increase an increasing margin of the yaw moment, when the rotation angle of the wheel portion 37 exceeds the engine rotation number increasing angle θ6, it is preferable to increase the increasing margin of the yaw moment by increasing both the rotation number of the engine 3L and the rotation number of the engine 3R to increase both the propulsive force F of the marine vessel propulsion device 4L and the propulsive force F of the marine vessel propulsion device 4R.

On the other hand, when the marine vessel 1 is navigating at a high speed, for example, at a speed of around 30 knots, since the propulsive force F of the marine vessel propulsion devices 4L and 4R is large, the yaw moment generated at this time point is also large, and the turning performance of the marine vessel 1 is originally high. Therefore, since it is not necessary to increase the increasing margin of the yaw moment very much even in the turning assist control, when the rotation angle of the wheel portion 37 exceeds the engine rotation number increasing angle θ6, only one of the rotation number of the engine 3L and the rotation number of the engine 3R is increased. In this case, it is possible to increase the yaw moment more than necessary, and it is possible to improve the turning performance of the marine vessel 1 sufficiently.

Although the turning assist control of the second preferred embodiment is applied to the marine vessel 1 moving forward in the high-speed navigating mode, the turning assist control of the second preferred embodiment may be applied to the marine vessel 1 moving forward in the low-speed navigating mode. In this case, even when the rotation angle of the wheel portion 37 exceeds the engine rotation number increasing angle θ6 and the rotation number of the engines 3L and 3R increases, the bucket opening is maintained at 70%.

Although preferred embodiments of the present invention have been described above, the present invention is not limited to the above-described preferred embodiments, and various modifications and changes can be made within the scope of the gist thereof.

For example, although the marine vessel 1 is equipped with the engines 3L and 3R as the power sources, the marine vessel 1 may include electric motors as the power sources instead of the engines 3L and 3R, or may include both engines and electric motors as the power sources.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel maneuvering system comprising:

a jet propulsion device to jet a water current out from a jetting port and obtain a propulsive force from a recoil of the jetted water current;

a handle to change a direction of the jetting port;

a reverse bucket to open and close the jetting port; and a controller programmed to change the direction of the jetting port in accordance with a rotation angle of the handle; wherein in a state in which the reverse bucket covers at least a portion of the jetting port, the rotation angle of the handle exceeds a first threshold, and the marine vessel moves forward, the controller is programmed to execute a turning assist control to reduce an amount by which the reverse bucket covers the jetting port.

2. The marine vessel maneuvering system according to claim 1, wherein, in the turning assist control, the controller is programmed to move the reverse bucket so that the reverse bucket does not cover the jetting port at all.

3. The marine vessel maneuvering system according to claim 1, wherein, in the turning assist control, the controller is programmed to reduce the amount by which the reverse bucket covers the jetting port as the rotation angle of the handle increases.

4. The marine vessel maneuvering system according to claim 1, further comprising:

a power source corresponding to the jet propulsion device to generate the water current; wherein the propulsive force increases when a rotation number of a crankshaft of the power source increases; and in the turning assist control, when the rotation angle of the handle exceeds a second threshold larger than the first threshold, the controller is programmed to increase the rotation number of the crankshaft of the power source.

5. The marine vessel maneuvering system according to claim 4, wherein, in the turning assist control, when the rotation angle of the handle exceeds the second threshold, the controller is programmed to increase the rotation number of the crankshaft of the power source as the rotation angle of the handle increases.

6. The marine vessel maneuvering system according to claim 4, wherein, in the turning assist control, the controller is programmed not to increase the rotation number of the crankshaft of the power source up to a maximum rotation number of the crankshaft of the power source when increasing the rotation number of the crankshaft of the power source.

7. The marine vessel maneuvering system according to claim 1, further comprising:

a power source corresponding to the jet propulsion device to generate the water current; wherein the propulsive force increases when a rotation number of a crankshaft of the power source increases; and in the turning assist control, when the rotation angle of the handle exceeds the first threshold, the controller is programmed to reduce the amount by which the reverse bucket covers the jetting port and increase the rotation number of the crankshaft of the power source.

8. The marine vessel maneuvering system according to claim 1, further comprising:

a throttle lever operable to move to a forward position from a neutral position to cause the marine vessel to move forward.

9. A marine vessel comprising:

the marine vessel maneuvering system according to claim 1.

10. A marine vessel maneuvering system comprising:

a jet propulsion device to jet a water current out from a jetting port and obtain a propulsive force from a recoil of the jetted water current;

a handle to change a direction of the jetting port;

a reverse bucket to open and close the jetting port; and a controller programmed to change the direction of the jetting port in accordance with a rotation angle of the handle; wherein in a state in which a marine vessel moves forward in a low-speed navigating mode and when the rotation angle of the handle exceeds a first threshold, the controller is programmed to reduce an amount by which the reverse bucket covers the jetting port.

11. The marine vessel maneuvering system according to claim 10, wherein, in the low-speed navigating mode, a moving range of the reverse bucket is limited to a predetermined range.

12. The marine vessel maneuvering system according to claim 10, further comprising:

a power source corresponding to the jet propulsion device to generate the water current; wherein the propulsive force increases when a rotation number of a crankshaft of the power source increases; and in the state in which the marine vessel has shifted to the low-speed navigating mode and when the rotation angle of the handle exceeds a second threshold larger than the first threshold, the controller is programmed to increase the rotation number of the crankshaft of the power source.

13. The marine vessel maneuvering system according to claim 12, wherein, in the low-speed navigating mode, an upper limit of the rotation number of the crankshaft of the power source is set to a predetermined rotation number that is different from a maximum rotation number.

14. The marine vessel maneuvering system according to claim 10, further comprising:

a throttle lever operable to move to a forward position from a neutral position to cause the marine vessel to move forward.

15. A marine vessel comprising:

the marine vessel maneuvering system according to claim 10.

16. A marine vessel maneuvering system comprising:

a jet propulsion device to jet a water current out from a jetting port and obtain a propulsive force from a recoil of the jetted water current;

a handle to change a direction of the jetting port;

a controller programmed to change the direction of the jetting port in accordance with a rotation angle of the handle; and a power source corresponding to the jet propulsion device to generate the water current; wherein the propulsive force increases when a rotation number of a crankshaft of the power source increases; and when a marine vessel moves forward and the rotation angle of the handle exceeds a predetermined threshold, the controller is programmed to increase the rotation number of the crankshaft of the power source.

17. The marine vessel maneuvering system according to claim 16, wherein, when the rotation angle of the handle exceeds the predetermined threshold, the controller is programmed to increase the rotation number of the crankshaft of the power source as the rotation angle of the handle increases.

18. The marine vessel maneuvering system according to claim 16, wherein the jet propulsion device includes a plurality of jet propulsion devices; and the power source includes a plurality of power sources corresponding to the plurality of the jet propulsion devices, respectively; and the controller is programmed to change the number of the jet propulsion devices that the rotation number is increased when the rotation angle of the handle exceeds the predetermined threshold in accordance with a speed of a marine vessel.

19. The marine vessel maneuvering system according to claim 16, further comprising:

a throttle lever operable to move to a forward position from a neutral position to cause the marine vessel to move forward.

20. A marine vessel comprising:

the marine vessel maneuvering system according to claim 16.

* * * * *